US007278700B2

(12) United States Patent
Yamaguchi et al.

(10) Patent No.: US 7,278,700 B2
(45) Date of Patent: Oct. 9, 2007

(54) PRINTING APPARATUS AND PRINTING METHOD

(75) Inventors: Hiromitsu Yamaguchi, Yokohama (JP); Satoshi Wada, Tokyo (JP); Makoto Akahira, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 280 days.

(21) Appl. No.: 11/148,332

(22) Filed: Jun. 9, 2005

(65) Prior Publication Data

US 2005/0275684 A1 Dec. 15, 2005

(30) Foreign Application Priority Data

Jun. 9, 2004 (JP) ..... 2004-171676

(51) Int. Cl.
*B41J 27/38* (2006.01)

(52) U.S. Cl. ..... 347/13; 347/42

(58) Field of Classification Search ..... 347/13, 347/42, 16, 49, 19, 15
See application file for complete search history.

(56) References Cited

U.S. PATENT DOCUMENTS 6,435,652 B1 * 8/2002 Rezanka ..... 347/42
6,655,771 B2 * 12/2003 Matsumoto et al. ..... 347/13
2002/0024557 A1 * 2/2002 Matsumoto et al. ..... 347/42

FOREIGN PATENT DOCUMENTS

JP 3-5992 1/1991

* cited by examiner

*Primary Examiner*—Lamson Nguyen
(74) *Attorney, Agent, or Firm*—Fitzpatrick, Cella, Harper & Scinto

(57) ABSTRACT

This invention relates to a printing apparatus and printing method which can stably print at high image quality on print media of various sizes by using a full-line printhead. The printing method uses a full-line printhead which has a long printing width and is configured by arraying a plurality of substrates each prepared by arraying a plurality of printing elements and each having a given printing width. When printing is done by conveying a print medium in a direction different from the array direction of the printing elements having the long printing width, printing elements used for printing are selected in accordance with an input image printing width so that an area printed on the print medium by printing elements corresponding to the connected portions between the substrates becomes a visually least perceivable area on the print medium. The relative moving amount of the full-line printhead to the print medium is so determined as to print by using the selected printing elements. The relative position of the full-line printhead is moved by the determined relative moving amount, and printing is done using the selected printing elements at the position after movement.

10 Claims, 21 Drawing Sheets

PRINTING APPARATUS AND PRINTING METHOD

FIELD OF THE INVENTION

This invention relates to a printing apparatus and printing method and, more particularly to an inkjet printing apparatus and printing method using a full-line printhead whose printing width covers the width of a print medium.

BACKGROUND OF THE INVENTION

A printing apparatus used as a printer, copying machine, or the like, or a printing apparatus used as an output device for a multifunction electronic apparatus or workstation including a computer and wordprocessor prints an image (including characters, symbols, and the like) on a print medium such as a paper sheet or thin plastic plate on the basis of printing information. Such printing apparatuses are classified by the printing method into an inkjet type, wire dot type, thermal type, laser beam type, and the like.

In a so-called serial type printing apparatus which performs printing operation while scanning a printhead in a direction (main scanning direction) perpendicular to the print medium conveyance direction (sub-scanning direction), a print medium is conveyed by a predetermined amount every time an image is formed by printing operation of scanning the printhead once along the print medium. After conveyance of the print medium is stopped, the print medium undergoes printing operation by the next scanning. By repeating this processing, printing is done on the entire print medium.

To the contrary, in a printing apparatus which incorporates a full-line printhead for only conveying a print medium in printing operation, a print medium is set at a predetermined position and conveyed while printing operation of every line is continuously performed, thereby printing on the entire print medium.

Among printing apparatuses of the above-mentioned types, a printing apparatus which adopts an inkjet printing method (inkjet printing apparatus) prints by discharging ink from a printhead onto a print medium. The inkjet printing apparatus has many advantages: the printhead can be easily downsized, a high-resolution image can be formed at a high speed, the running cost is low because printing can be done on a plain sheet without requiring any special processing, noise is hardly generated because of non-impact printing, and an arrangement to form a color image with multicolor ink can be easily employed.

Of these printing apparatuses, a line printer using a so-called full-line printhead configured by arraying many printing elements and many ink orifice nozzles in a direction perpendicular to the print medium conveyance direction can achieve a higher image formation speed, and attracts attention as a candidate for a printing apparatus which satisfies recent needs for on-demand printing On-demand printing is required to be laborsaving, instead of realizing high-speed printing of, e.g., 100,000 sheets per hour, unlike conventional printing of newspapers and magazines in millions of copies. The line printer using a full-line printhead is much lower in printing speed than a conventional printing apparatus for offset printing type or the like, but can save labor and is suitable for on-demand printing because no printing plate need be formed.

The line printer which adopts the full-line printhead and is used for on-demand printing must print on A3-size print media by 30 pages or more per minute at a resolution of 600×600 dpi (dots per inch) for a monochrome printing document such as a text and a resolution of 1,200×1,200 dpi or more for a full-color image such as a photograph. Also, the line printer must flexibly print on print media of a plurality of sizes: for example, the printer outputs an image photographed by a digital camera or the like on an L-size print medium, similar to a conventional printing apparatus, or the printer prints on a small print medium such as a postcard.

It is, however, difficult to faultlessly machine and manufacture all ink discharge nozzles (to be referred to as nozzles hereinafter) and printing elements arrayed along the entire width of the printing area in the line printer using the full-line printhead. For example, a full-line printhead used for a line printer which prints a photographic output on a large-size paper sheet, like business documents in an office, requires about 14,000 nozzles (printing width of about 280 mm) in order to print at a resolution of 1,200 dpi on an A3-size paper sheet. It is hard for the manufacturing process to faultlessly machine and manufacture such a large number of nozzles and corresponding printing elements. Even if a printhead can be manufactured faultlessly, the fraction defective and manufacturing cost rise.

To prevent this problem, there is proposed a line printer type inkjet printing apparatus using a full-line printhead which is implemented by a so-called "connecting head". The "connecting head" is a printhead which attains a long printing width with arraying at high precision a plurality of printhead chips which are adopted in a serial type printing apparatus and have a short printing width at a relatively low cost. For example, Japanese Patent Publication for Opposition No. 3-5992 discloses a full-multistructure in which inkjet printheads are staggered above and below one common plate.

As advantages of using the connecting head, the manufacturing cost can be reduced by increasing the manufacturing yield, and the maximum printing width of the printhead can be relatively easily changed in accordance with the number of short-printing-width printhead chips to be arrayed.

However, the conventional "connecting head" readily degrades the print image quality at the connected portion between chips owing to the structure of the head. More specifically, the chip array shifts, the nozzle pitch of a nozzle adjacent to the connected portion changes from that at the remaining portions, and a stripe appears on a printed image.

By arraying a plurality of chips used for a short-printing-width printhead having an arbitrary number of nozzles, printheads having various printing widths can be easily configured by changing the number of chips to be arrayed. However, it is difficult to configure a printhead at a width equal to a printing width (generally a regular size) necessary for printing on a print medium. As a general arrangement, therefore, the number of chips is often increased to design the printing width of the printhead to be larger than the maximum width of a print medium. This means that many nozzles and printing elements are kept unused.

There have conventionally been proposed various solutions for the problems of the "connecting head".

To eliminate a stripe generated at the connected portion between chips, there is proposed a method of increasing the physical machining accuracy of a printhead (e.g., an arraying method of increasing the chip array precision at the connected portion, or a method of decreasing the shift of the nozzle pitch by an alignment apparatus).

There is also proposed a method of not arraying nozzles corresponding to a connected portion so that nozzles at the ends of chips become adjacent to each other, but arraying chips so that nozzles at the ends of the chips overlap each other, and discharging ink from the overlapping nozzles so as to make a stripe inconspicuous.

Further, there is devised a method of changing the discharge amount of ink droplets discharged from nozzles at a connected portion so that printing nonuniformity at the connected portion does not stand out.

As for nozzles and printing elements which are kept unused owing to the difference between the maximum width of a print medium and the printable width of a printhead configured by arraying a plurality of chips each having an arbitrary number of nozzles, unused printing elements are not connected in the circuit configuration, and corresponding nozzles are defined as undischargeable nozzles and are not used. As a method of preventing image degradation caused by connecting chips, even unused nozzles are partially used as dischargeable nozzles in the circuit configuration when printheads are arranged in a printing apparatus so as to change the connected portion between respective colors.

Even with these measures, image degradation at the connected portion between chips cannot be completely prevented in the entire area of a printed image when images are printed on print media of various sizes by using the "connecting head".

SUMMARY OF THE INVENTION

Accordingly, the present invention is conceived as a response to the above-described disadvantages of the conventional art.

For example, a printing apparatus and a printing method according to the present invention are capable of stably printing at high image quality on print media of various sizes by using a full-line printhead configured by connecting a plurality of chips used for a short-printing-width printhead.

According to one aspect of the present invention, preferably, there is provided a printing apparatus which incorporates a full-line printhead that is configured by arraying a plurality of substrates each prepared by arraying a plurality of printing elements and each having a first printing width and that has a second printing width larger than the first printing width, and which conveys a print medium in a direction different from an array direction of the plurality of printing elements having the second printing width to print on the print medium, comprising: moving means for moving a relative position of the full-line printhead in the array direction of the plurality of printing elements which form the full-line printhead; input means for inputting an image printing width on the print medium; selection means for selecting printing elements to be used for printing at the image printing width in accordance with the image printing width input from the input means; determination means for determining a moving amount by the moving means so as to print by using the printing elements selected by the selection means; moving control means for controlling the moving means to move a relative position of the full-line printhead to the print medium by the moving amount determined by the determination means; and printing control means for controlling to print by using the printing elements selected by the selection means at the position to which the full-line printhead is moved by the moving means.

The selection means desirably selects printing elements so as to decrease a frequency at which areas printed on the print medium by using printing elements corresponding to connected portions between the plurality of substrates appear on the print medium, in comparison with a frequency before selection by the selection means.

Movement by the moving means and selection by the selection means are desirably performed in a case where the image printing width is smaller than the second printing width.

In order to make an area printed on the print medium by the printing elements corresponding to the connected portions between the plurality of substrates be a visually least perceivable area on the print medium, the selection means desirably selects printing elements: (1) so as to print in an area at an end of the print medium by printing elements corresponding to connected portions between the plurality of substrates; (2) so as to minimize printing by the printing elements corresponding to the connected portions between the plurality of substrates; or (3) in consideration of factors (1) and (2).

Movement of the relative position of the full-line printhead to the print medium in the array direction of the plurality of printing elements which form the full-line printhead is preferably implemented by directly moving the full-line printhead or moving a print medium supply position in accordance with the size of the print medium.

The printing apparatus having the above arrangement may comprise a plurality of full-line printheads along a conveyance direction of the print medium for color printing.

According to another aspect of the present invention, preferably, there is provided a printing method of printing on a print medium by employing a full-line printhead that is configured by arraying a plurality of substrates each prepared by arraying a plurality of printing elements and each having a first printing width and that has a second printing width larger than the first printing width, and conveying the print medium in a direction different from an array direction of the plurality of printing elements having the second printing width, comprising: an input step of inputting an image printing width on the print medium; a selection step of selecting printing elements to be used for printing at the image printing width in accordance with the image printing width input at the input step; a determination step of determining a moving amount of the full-line printhead so as to print by using the printing elements selected at the selection step; a moving control step of controlling to move a relative position of the full-line printhead to the print medium by the moving amount determined at the determination step in the array direction of the plurality of printing elements which form the full-line printhead; and a printing control step of controlling to print by using the printing elements selected at the selection step at the position to which the full-line printhead is moved at the moving control step.

The invention is particularly advantageous since printing by printing elements corresponding to the connected portions between a plurality of substrates can be performed in a visually less perceivable area on the print medium so as to hardly recognize degradation in the quality of a printed image.

Further, a printing apparatus using a full-line printhead capable of high-quality printing can be provided at low cost.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

Furthermore, unless otherwise stated, the term "nozzle" generally means a set of a discharge orifice, a liquid channel connected to the orifice and an element to generate energy utilized for ink discharge.

The following printhead substrate (head substrate) means not only a base of a silicon semiconductor but also a base having elements, wiring lines, and the like.

Furthermore, the term "on a substrate" means not only "on an element substrate", but also "the surface of an element substrate" or "inside an element substrate near the surface". The term "built-in" in the present invention does not represent that each separate element is arranged as a separate member on a substrate surface, but represents that each element is integrally formed and manufactured on an element substrate by a semiconductor circuit manufacturing process or the like.

Figure 1:
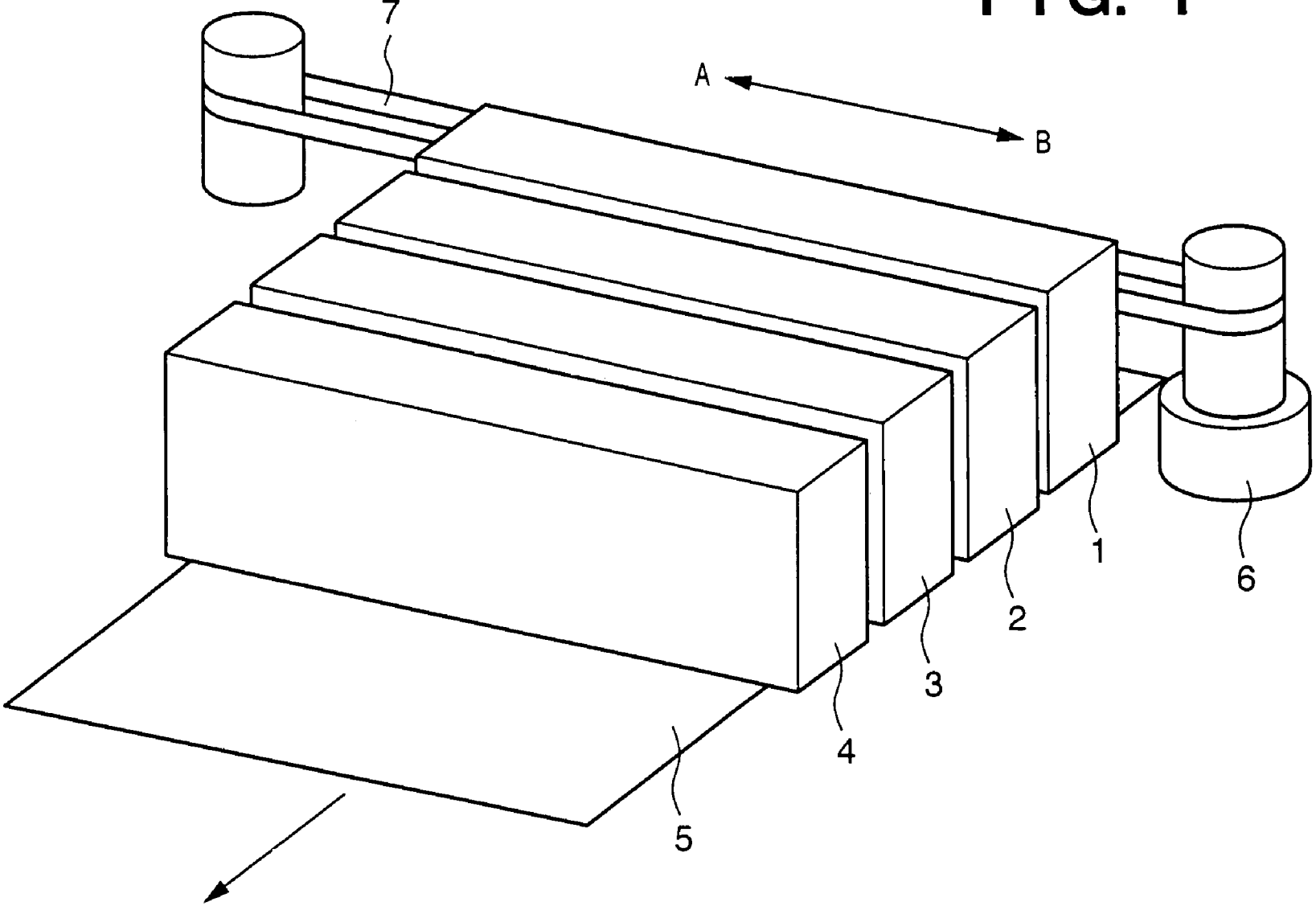
FIG. 1 is a schematic view showing the arrangement of an inkjet printing apparatus as a typical embodiment of the present invention.

FIG. 1 is an outer perspective view showing the schematic arrangement of an inkjet printing apparatus (to be referred to as a printing apparatus hereinafter) as a typical embodiment of the present invention.

As shown in FIG. 1, the printing apparatus comprises four full-line printheads (to be referred to as printheads hereinafter) 1 to 4 each having a printing width corresponding to that of a print medium 5. These printheads each have an array of ink discharge nozzles (to be referred to as nozzles hereinafter) for discharging ink. The printheads 1 to 4 respectively discharge inks of black (K), cyan (C), magenta (M), and yellow (Y). These printheads are connected to ink supply tubes (not shown) for supplying inks from ink tanks (not shown), and receive a control signal and printing signal from a control circuit via a flexible cable (not shown).

Examples of the print medium 5 are plain paper, high-quality dedicated paper, an OHP sheet, glossy paper, a glossy film, and a postcard. The print medium 5 is clamped between conveyance rollers (not shown), delivery rollers (not shown), or the like, and conveyed in a direction (conveyance direction) indicated by an arrow along with driving of a conveyance motor (not shown). The nozzles (fluid channels) of the printheads 1 to 4 incorporate printing elements (electrothermal transducers or heaters) which generate thermal energy for discharging ink. In printing, the print medium 5 is conveyed in the direction indicated by the arrow. Along the conveyance direction, a linear encoder (not shown) is arranged to specify the position of the print medium. The printing elements are driven on the basis of a printing signal according to the read timing of the print medium position by the linear encoder, and ink droplets are discharged and attached onto the print medium, thereby printing an image.

The printheads 1 to 4 constitute one unit as a whole, and the unit is attached to a printhead moving belt 7. The printhead moving belt 7 is moved by driving a printhead position control motor 6 in accordance with the width of a print image or the size of a print medium, and the printheads 1 to 4 can be moved in a direction indicated by an arrow A or B in FIG. 1.

While no printing is done, the ink orifice surfaces of the printheads 1 to 4 are closed with a capping mechanism (not shown) so as to prevent clogging caused by fixation of ink upon evaporation of the ink solvent or attachment of a foreign matter such as dust.

In order to solve a discharge failure and clogging at a nozzle whose printing frequency is low, the capping function of the capping mechanism is utilized for preliminary discharge of discharging ink to a cap portion separated apart from the nozzle, or for recovery of a nozzle suffering a discharge failure by operating a pump (not shown) and sucking ink from the nozzle while capping the ink discharge surface of the printhead. Also, the ink discharge surface of the printhead can be cleaned by arranging a blade or wiping member (not shown) at a position adjacent to the cap portion.

Figure 2:
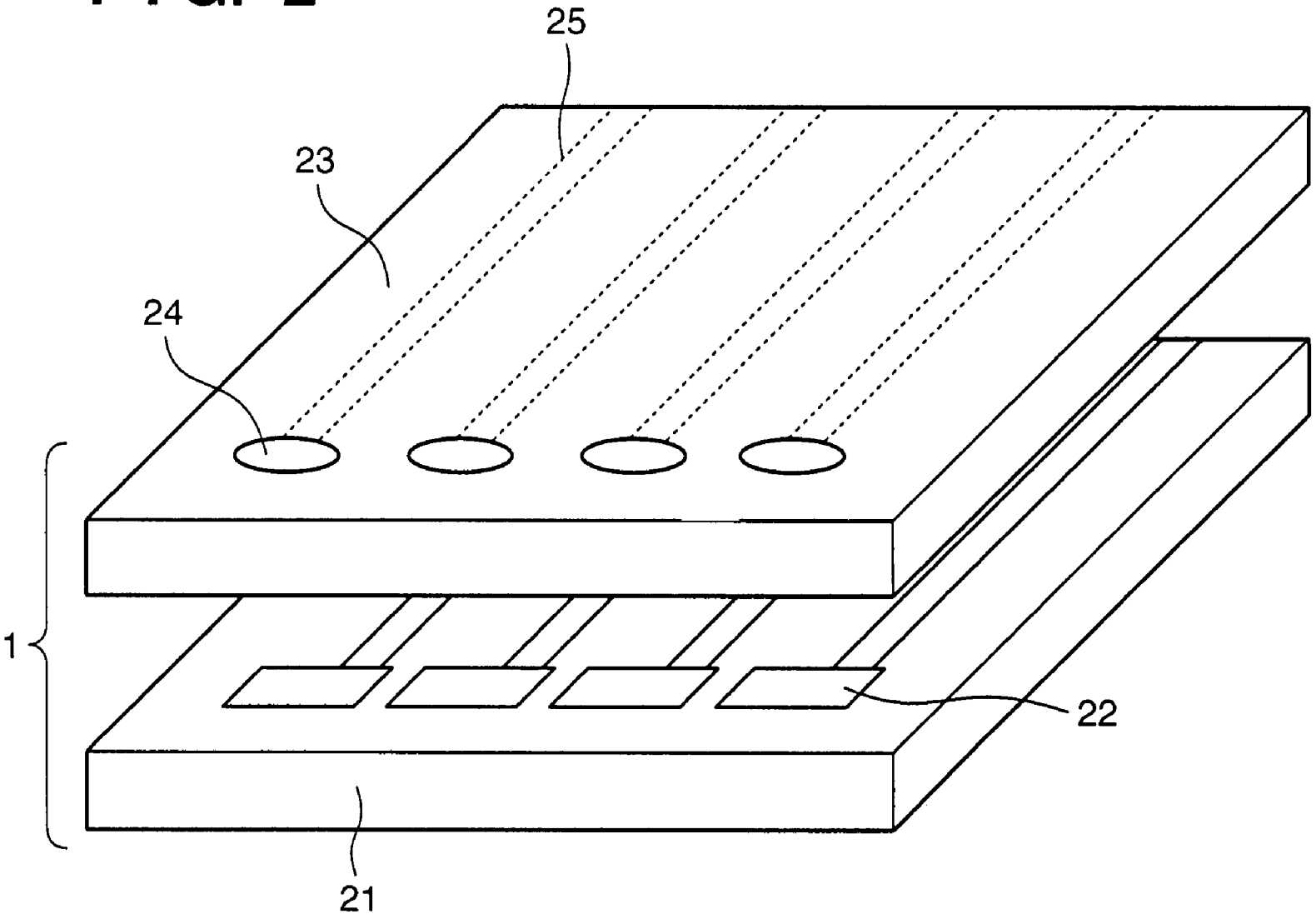
FIG. 2 is a view schematically showing the structure of part of a printhead used in the inkjet printing apparatus shown in FIG. 1.

FIG. 2 is a perspective view showing part of the printhead structure shown in FIG. 1. The printheads 1 to 4 have the same basic structure, and FIG. 2 exemplifies the printhead 1.

As shown in FIG. 2, the printhead 1 is configured by forming a plurality of heaters 22 for heating ink on a heater board 21 serving as a substrate, and covering the heater board 21 with a top plate 23. The top plate 23 has a plurality of nozzles 24, and tunnel-like fluid channels 25 connecting to the nozzles 24 are formed on the back side of the nozzles 24. The fluid channels 25 are commonly connected to one ink chamber (not shown) on the back side. The ink chamber receives ink from an ink tank via an ink supply port, and the ink is supplied from the ink chamber to the respective fluid channels 25.

The heater board 21 and top plate 23 are aligned and assembled so that the heaters 22 are located at positions corresponding to the fluid channels 25.

FIG. 2 shows only four heaters 22, but the heaters 22 are arranged in one-to-one correspondence with the respective fluid channels 25. When a predetermined driving pulse is supplied to the heater 22 while the heater board 21 and top plate 23 are assembled as shown in FIG. 2, ink on the heater 22 boils and forms bubbles, and is squeezed and discharged from the nozzle 24 by volume expansion of the bubbles.

Note that the inkjet printing method applicable to the present invention is not limited to a thermal type of printing apparatus using an electrothermal transducer (heater) as shown in FIGS. 1 and 2. For example, for a continuous printing apparatus which continuously ejects ink droplets so as to form ink particles, a charge control method, divergence control method, and the like can be applied. For an on-demand printing apparatus which discharges ink droplets, as needed, a pressure control method of discharging ink droplets from orifices by mechanical vibrations of a piezoelectric vibrator can be applied.

Figure 3:
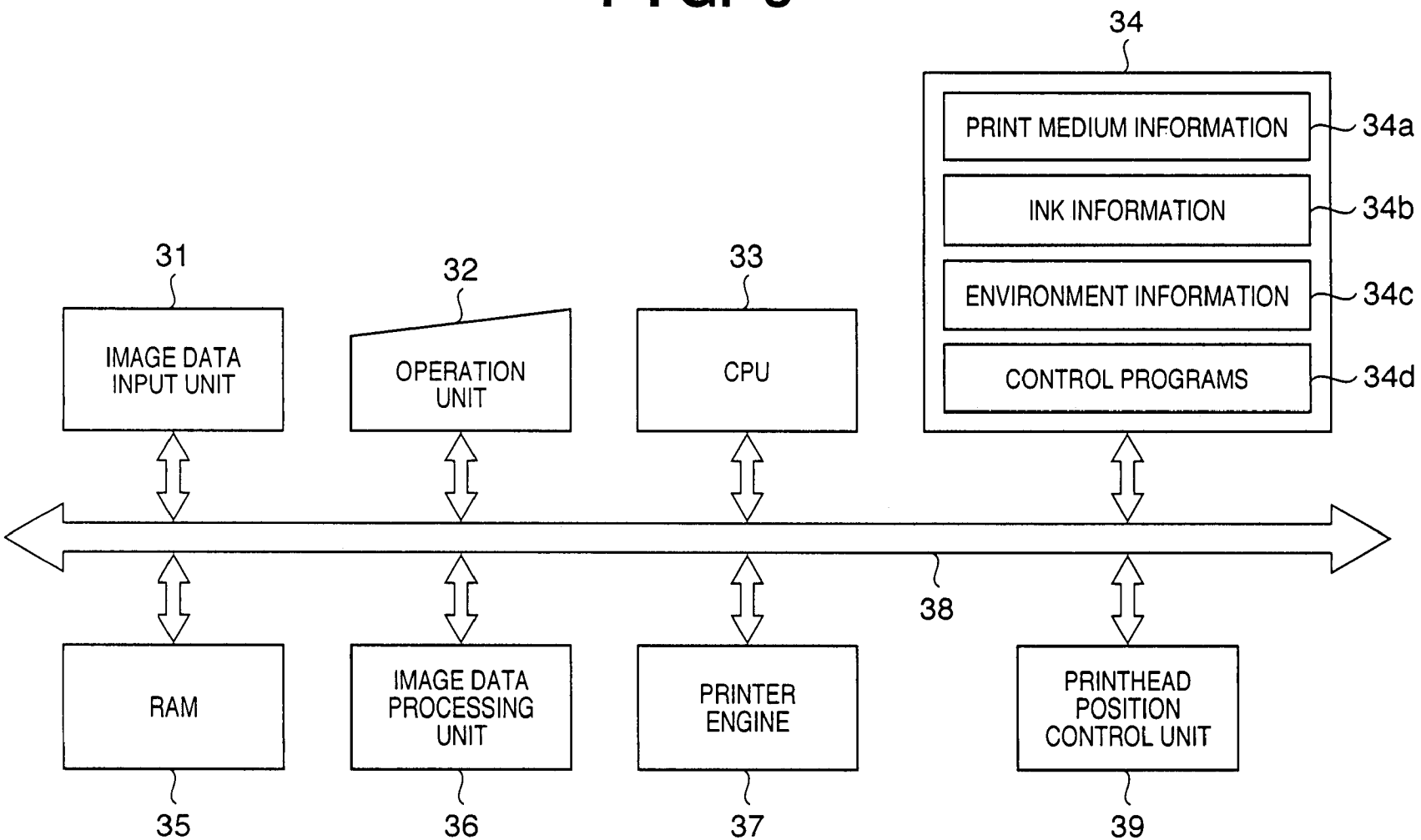
FIG. 3 is a block diagram showing the arrangement of the control circuit of the inkjet printing apparatus shown in FIG. 1.

FIG. 3 is a block diagram showing the control arrangement of the printing apparatus shown in FIG. 1.

In FIG. 3, reference numeral 31 denotes an image data input unit; 32, an operation unit; 33, a CPU which performs various processes accompanying printing control and controls the overall printing apparatus; and 34, a nonvolatile memory (e.g., ROM, EEPROM, FeRAM, MRAM, or RRAM) which stores various data. As other examples of the nonvolatile memory, especially a storage medium which stores a program, an FD, CD-ROM, HD, memory card, memory stick, and magneto-optical disk are also available.

The nonvolatile memory 34 includes a storage unit 34*a* which stores information on mainly the type of print medium, a storage unit 34*b* which stores information on ink used for printing, a storage unit 34*c* which stores information on the environment such as the temperature and humidity in printing, and a storage unit 34*d* which stores various control programs used for printing control (to be described later). Reference numeral 35 denotes a RAM; 36, an image data processing unit; 37, a printer engine which outputs an image; 38, a bus which transfers an address signal, data, control signal, and the like between building components; and 39, a printhead position control unit which controls the relative positions of the printheads 1 to 4 and print medium 5.

These building components will be described in detail. The image data input unit 31 receives multi-valued image data from an image input device such as a scanner or digital camera, and multi-valued image data saved in the hard disk of a personal computer or the like. The operation unit 32 comprises various keys which allow the user to designate the start of printing and set various parameters pertaining to printing operation (e.g., the image printing width, the size of a print medium, the type of print medium, and the type of print image (picture/photo, graphics, character, or the like)).

The RAM 35 is used as a work area used to execute various programs stored in the nonvolatile memory 34 by the CPU 33, a temporary save area in error processing, and a work area in image processing. The RAM 35 is also used when various tables stored in the nonvolatile memory 34 are copied, then the contents of the tables are changed, and image processing proceeds by referring to the changed tables.

The image data processing unit 36 quantizes input multi-valued image data into n-ary image data for each pixel, and generates an ink discharge pattern corresponding to a gray value "K" represented by each quantized pixel. That is, the image data processing unit 36 performs n-ary processing for input multi-valued image data, and creates an ink discharge pattern corresponding to the gray value "K".

For example, according to the embodiment, when multi-valued image data which expresses the component of each pixel by 8 bits (256 gray levels) is input to the image data input unit 31, the image data processing unit 36 converts the gray value of output image data into a 25 (=24+1) value. K-ary processing for input grayscale image data can adopt, e.g., a multi-valued error diffusion method, but may employ another method such as an arbitrary half-toning processing method (e.g., average density conservation method or dither matrix method). By repeating this k-ary processing for all pixels on the basis of density information of the image, binary driving signals representing whether to discharge ink or not are created for pixels corresponding to nozzles.

The printer engine 37 discharges ink on the basis of the discharge pattern generated by the image data processing unit 36, and forms a dot image on a print medium.

In addition to the above arrangement, the printing apparatus comprises an interface (not shown) which receives image data, a printing instruction, and control information from an external device (e.g., host computer). The same information as that input by the user from the operation unit 32 may be received from an external device through this interface.

Actual printing operation executed by the printing apparatus having the above arrangement will be explained with reference to FIGS. 4 to 10.

Print data can be prepared in accordance with a method used in a general inkjet printing apparatus. In the embodiment, color image data of an input image is decomposed into four color components in accordance with the four printheads, and halftone image data of the decomposed color components are binarized using an error diffusion method. In this way, data to be printed by the printheads 1 to 4 is prepared.

The arrangement of an actual full-line printhead will be explained.

Figure 4:
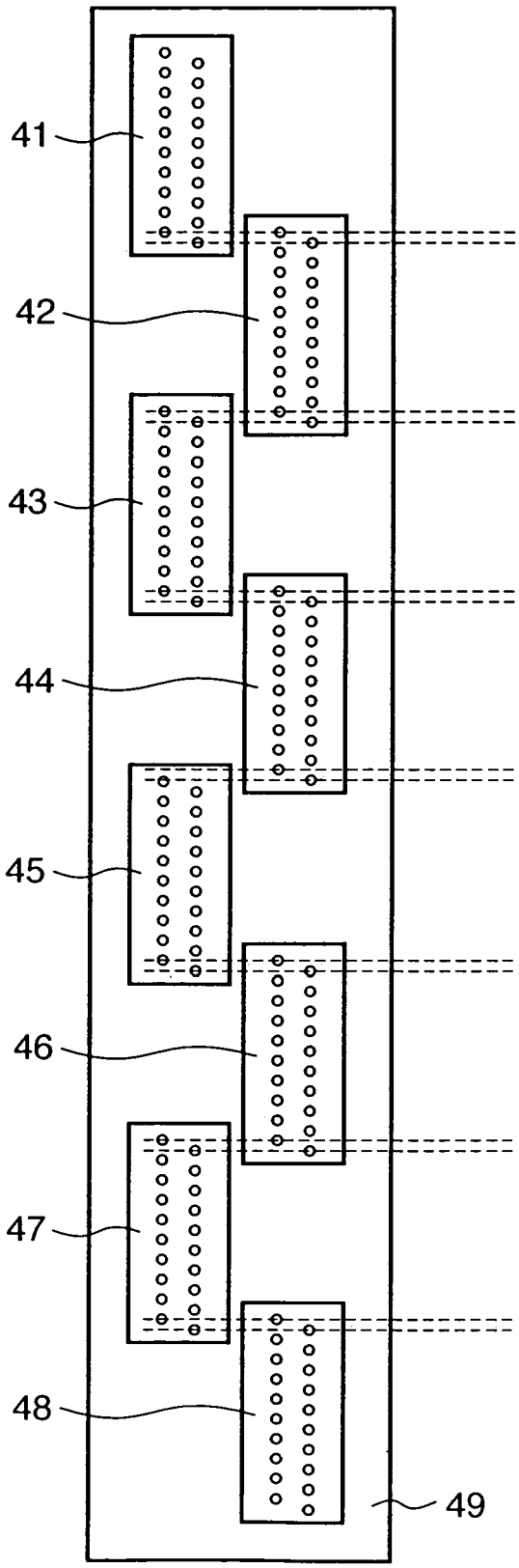
FIG. 4 is a schematic view showing the layout of a plurality of nozzles in a full-line printhead.

FIG. 4 is a schematic view showing the layout of a plurality of nozzles in the full-line printhead.

As shown in FIG. 4, the full-line printhead of the embodiment includes a nozzle group 49 with a long printing width as a whole by laying out a plurality of chips (in FIG. 4, a total of eight chips 41 to 48) each having a nozzle group with a relatively short printing width (i.e., the number of nozzles is small) while staggering the chips in the nozzle array direction.

As shown in FIG. 4, chips each having a short printing width are arrayed with a positional relationship in which at least two nozzles (in FIG. 4, two nozzles) overlap corresponding nozzles at the end of each nozzle group laid out with a shift. Ink droplets discharged from overlapping nozzles can land on the same printing matrix when the printhead scans in relative to a print medium to print (in practice, the printhead is fixed and a print medium is conveyed).

Figure 5:
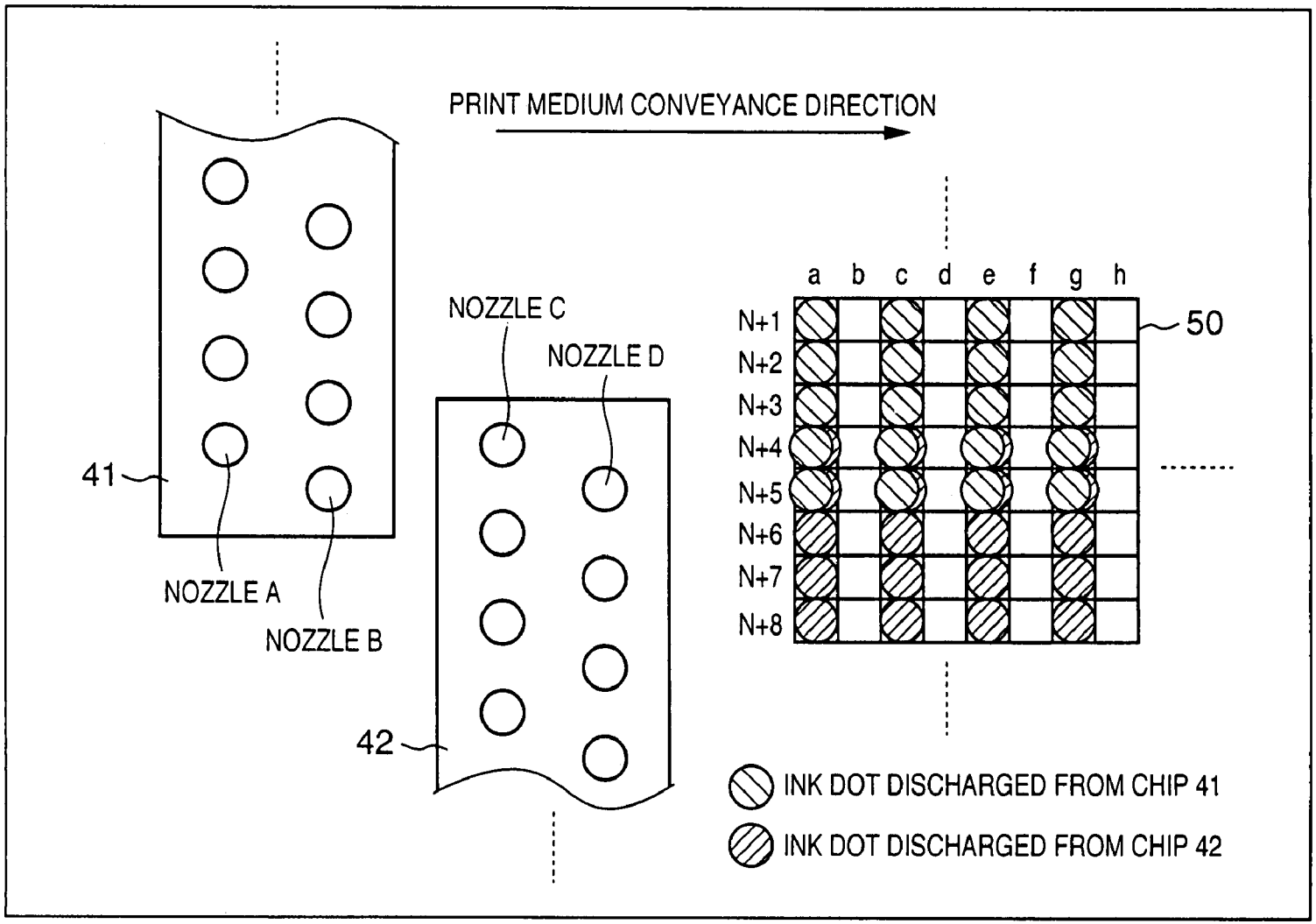
FIG. 5 is a view showing the relationship between the nozzle layout and the ink discharge position.

FIG. 5 is a view showing the relationship between the nozzle layout and the ink discharge position.

As shown in FIG. 5, ink droplets discharged from nozzle A of the chip 41 and nozzle C of the chip 42 are attached in (N+4,a), (N+4,c), (N+4,e), and (N+4,g) on a printing matrix 50. Ink droplets discharged from nozzle B of the chip 41 and nozzle D of the chip 42 are attached in (N+5,a), (N+5,c), (N+5,e), and (N+5,g) on the printing matrix 50.

Figure 6:
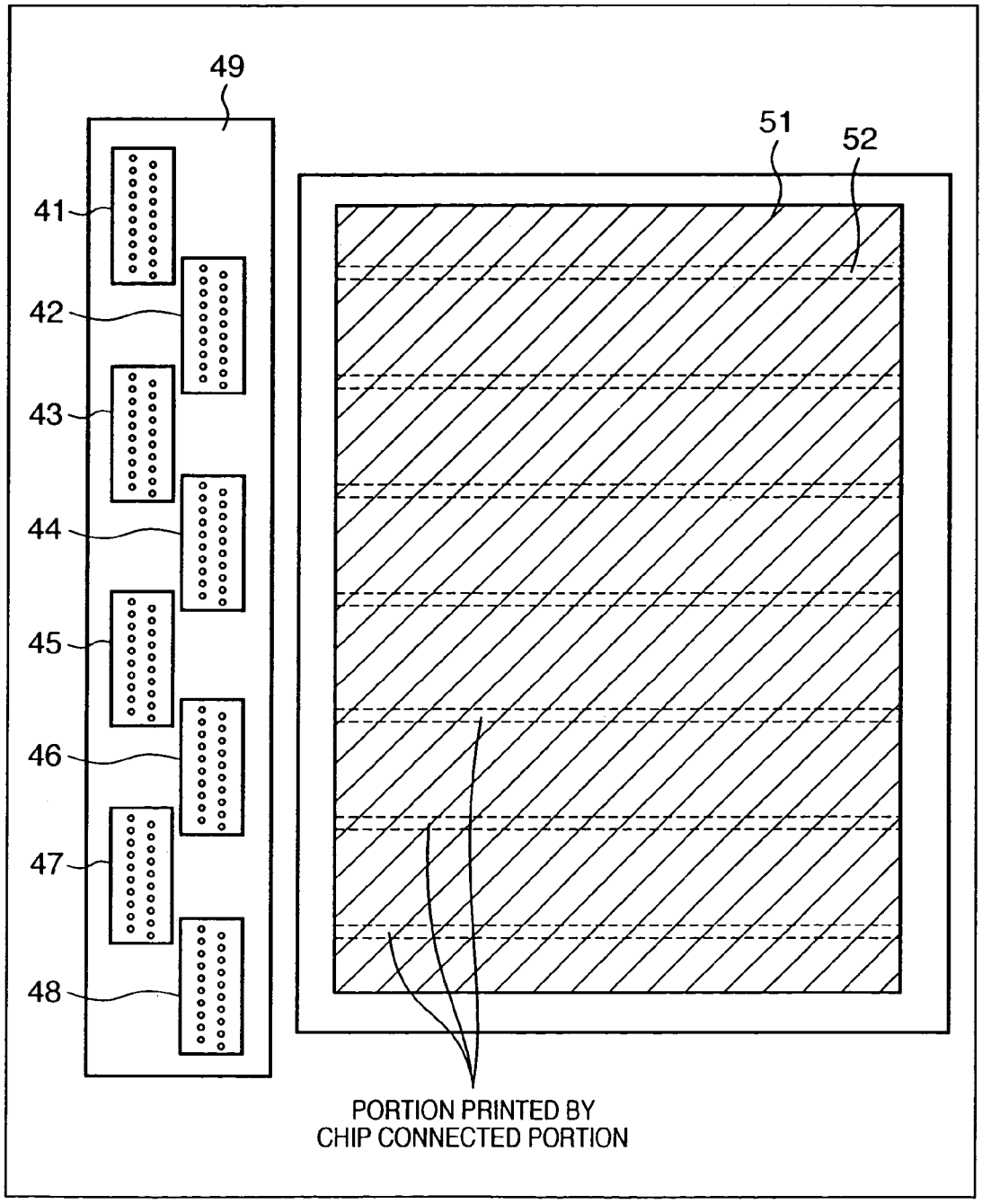
FIG. 6 is a schematic view showing the relationship between the nozzle layout and an image printed using a full-line printhead having the nozzle layout shown in FIG. 4.

FIG. 6 is a schematic view showing the relationship between the nozzle layout and an image printed using a full-line printhead having the nozzle layout shown in FIG. 4.

A printed image 51 shown in FIG. 6 includes seven portions 52 printed by the connected portions between chips. In FIG. 6, the portions 52 are indicated by broken lines.

An actual printing method according to the embodiment will be described in detail.

As shown in FIGS. 1 and 3, the printing apparatus comprises the printhead position control motor 6, printhead moving belt 7, and printhead position control unit 39 as a means for moving the printheads 1 to 4 in a direction parallel to the nozzle array direction.

The CPU 33 can move the printheads 1 to 4 in the directions indicated by the arrows A and B in FIG. 1 by operating the printhead position control motor 6 and printhead moving belt 7 via the printhead position control unit 39.

Printhead position control by the CPU 33 will be explained with reference to a flowchart.

Figure 7:
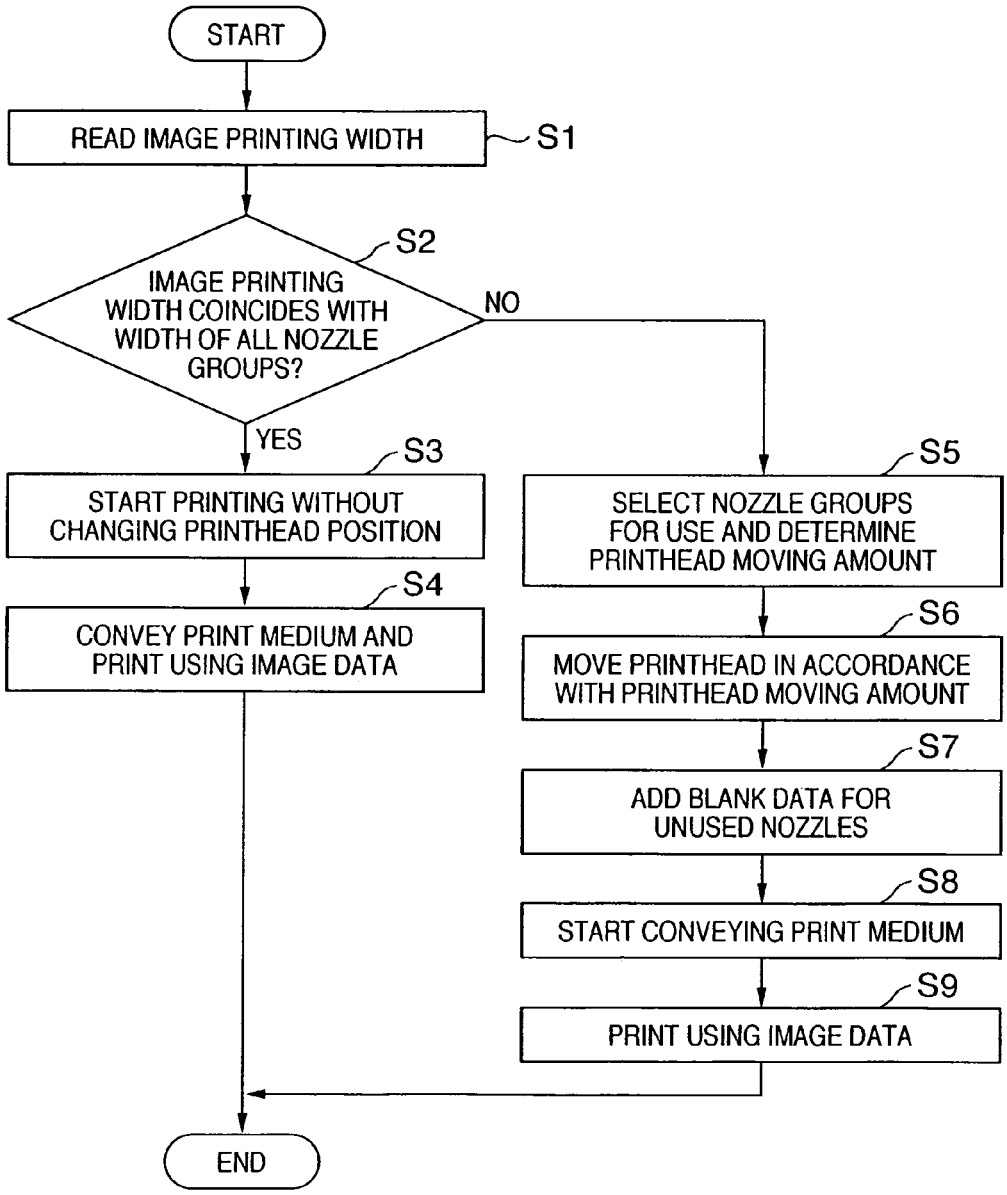
FIG. 7 is a flowchart showing printhead position control processing.

FIG. 7 is a flowchart showing printhead position control processing.

When a printing instruction is executed, the CPU 33 reads an image printing width (PW) in step S1. This printing width may be the size of an image to be printed, or the regular size (e.g., B5 or A4) of a print medium when printing is done on the entire print medium. When the size of a print medium is unknown, it may be detected by, e.g., a detection mechanism (not shown) which detects the width of a print medium upon feeding it. Alternatively, a size adjusted in accordance with that of an image to be printed may be set.

In step S2, the CPU 33 determines on the basis of the read printing width whether the image size is either the width of an image to be printed using all the nozzle groups of the printhead or the width of an image printable by arbitrary nozzle groups.

If it is determined that the printing width corresponds to printing using all the nozzle groups of the printhead, the processing advances to the process of step S3. If it is determined that the printing width is printable by arbitrary nozzle groups of the printhead (i.e., the image width is much smaller than the maximum printing width of the printhead), the processing advances to step S5.

In step S3, the CPU 33 controls the printheads 1 to 4 to start printing without changing the printhead positions.

Figure 8:
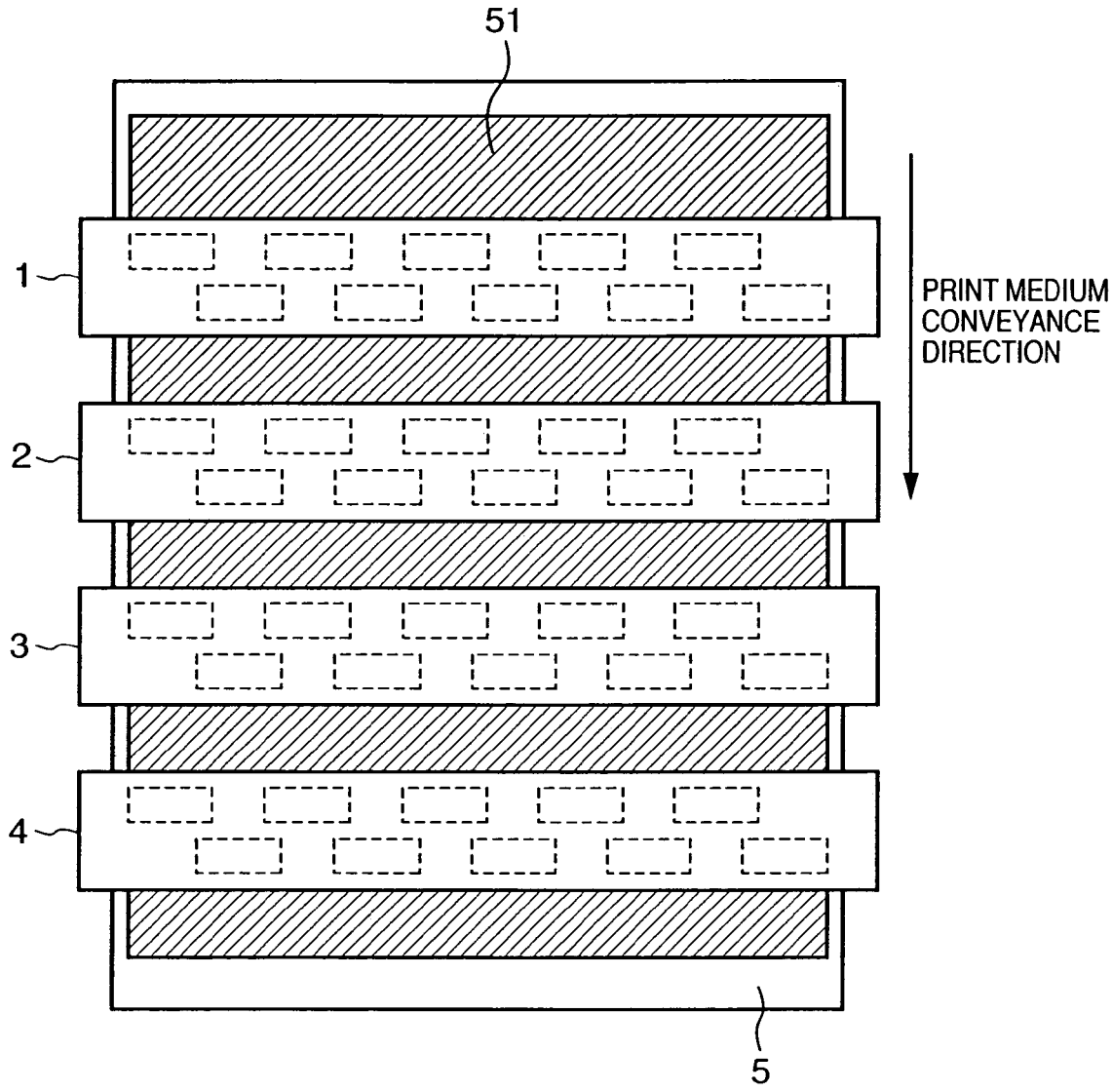
FIG. 8 is a view schematically showing a case where an image is formed without changing the printhead position.

FIG. 8 is a view schematically showing a case where an image is formed without changing the printhead position.

In step S4, the CPU 33 controls the conveyance belt to start conveying the print medium 5 at a predetermined speed.

When the print medium reaches the printing positions of the printheads, the printheads 1 to 4 are driven in accordance with a printing signal generated on the basis of image data according to the read timing of the linear encoder, and ink droplets are discharged and attached from the nozzles onto the print medium, thereby forming an image.

In step S5, nozzle groups for use in the printhead are determined in accordance with the image printing width read in advance, and the printhead moving amount is determined. This printhead moving amount is set suitable for moving, to a desired image formable position on a print medium, nozzle groups which are selected from all the nozzle groups of the printhead so as to be able to print at a visually least perceivable position even if the image quality slightly degrades at the connected portion between chips.

In step S6, the printhead position control unit 39 drives the printhead position control motor 6 in accordance with the determined moving amount, and moves the printheads 1 to 4.

Figure 9:
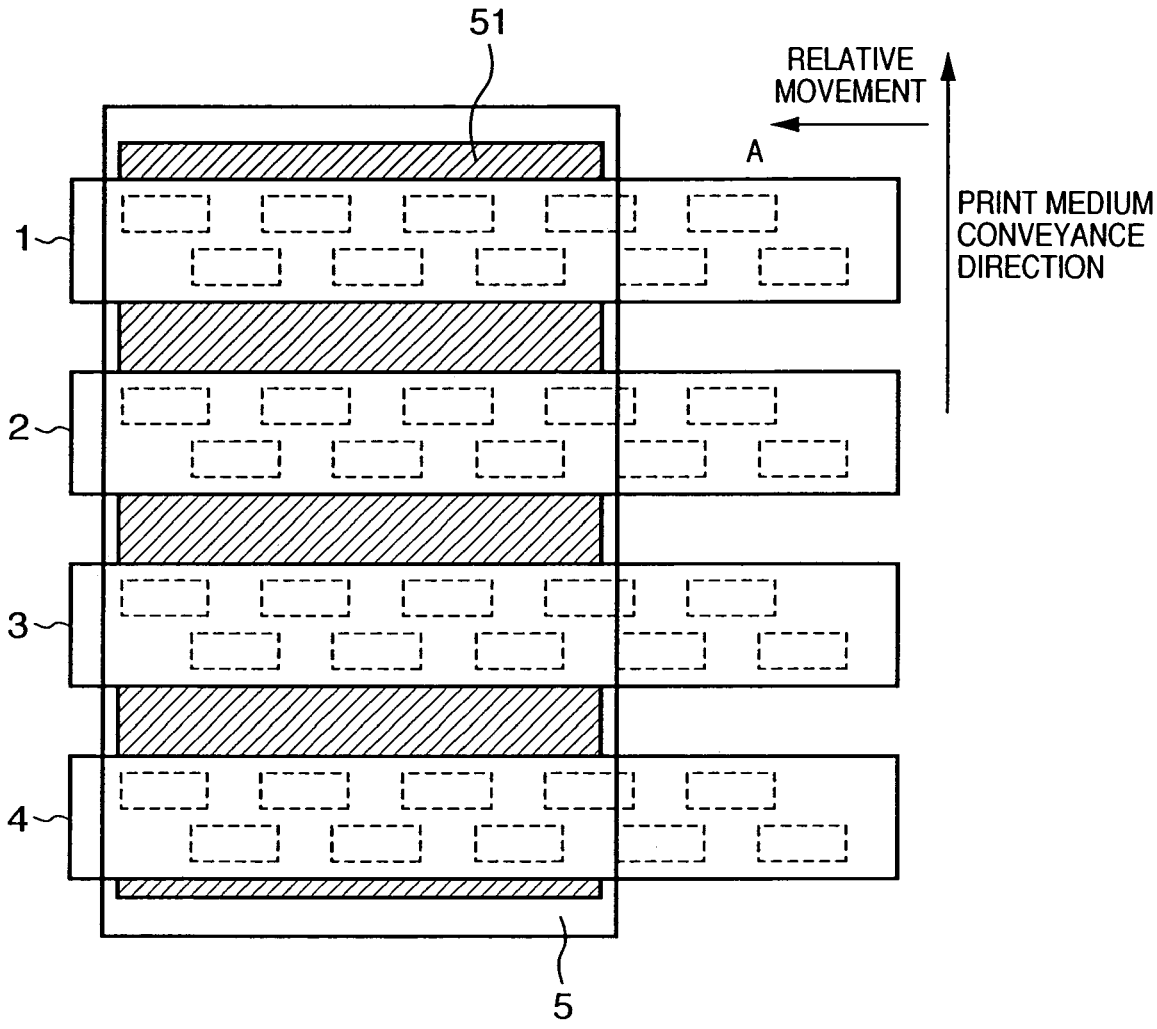
FIG. 9 is a schematic view showing a state in which the printheads 1 to 4 are moved in a direction indicated by an arrow A in FIG. 1.
Figure 10:
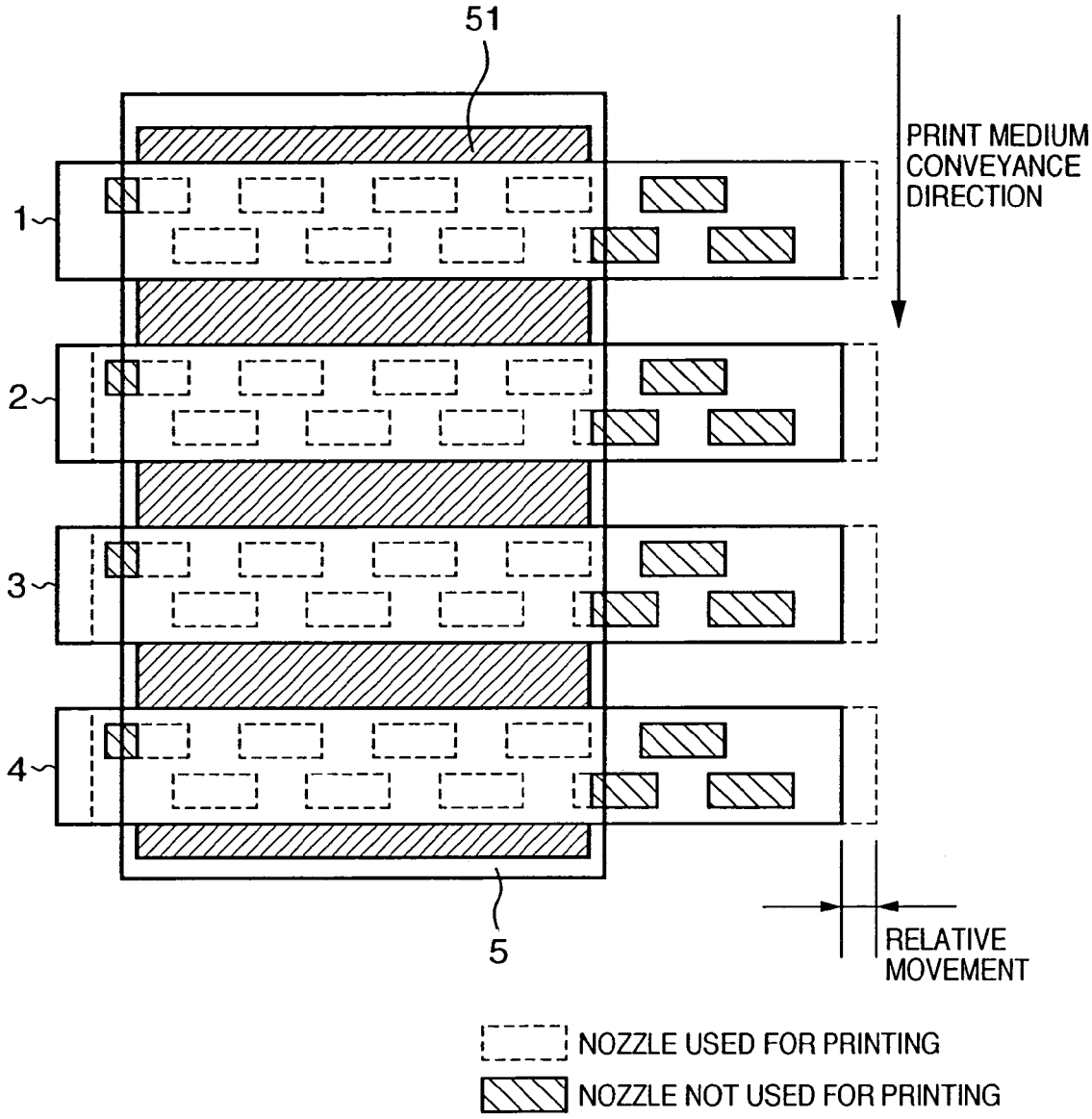
FIG. 10 is a view showing nozzles used for printing and nozzles not used for printing as a result of moving the printhead.

FIG. 9 is a schematic view showing a state in which the printheads 1 to 4 are moved in the direction indicated by the arrow A in FIG. 1. FIG. 10 is a view showing nozzles used for printing and nozzles not used for printing as a result of moving the printhead.

As a result of moving the printhead in step S6, unused nozzles and unused nozzle groups are determined in the printheads 1 to 4, as shown in FIG. 10.

In step S7, processing of adding blank data to image data is executed by transferring dummy image data so as to prevent ink discharge from unused nozzle groups and unused nozzles.

In step S8, conveyance of the print medium starts at a predetermined speed. When the print medium reaches the printing positions of the printheads 1 to 4, the printheads discharge ink onto the print medium to form an image in step S9.

In the printed image, an image formed by a portion corresponding to the connected portion between chips cannot be visually discriminated. Even after printing is continuously repeated, the connected portion cannot be visually perceived from the printed image.

According to the above-described embodiment, when there are nozzle groups not used for printing in accordance with the print image width, blank image data is added to image data as processing of preventing ink discharge from these unused nozzle groups in printing. However, this processing does not limit the present invention.

For example, as processing of preventing ink discharge from unused nozzles, the width of a driving pulse to be applied to the printing element may be set small enough to prevent ink discharge, or no pulse may be applied. Alternatively, a driving voltage to be applied to unused nozzles may be set to a value enough to prevent ink discharge, or no driving voltage may be applied.

The above embodiment has described a printing apparatus which adopts the inkjet method. The present invention is also effective for degradation in image quality caused by stripes or nonuniformity of an image owing to an error of the printing element array in the arrangement of the printing elements even in a printing apparatus which uses a full-line printhead and adopts another printing method such as the wire dot method or thermal method. Thus, the printhead may comply with another printing method such as the wire dot method or thermal method.

Embodiments of the present invention will be explained in more detail.

First Embodiment

Figure 11:
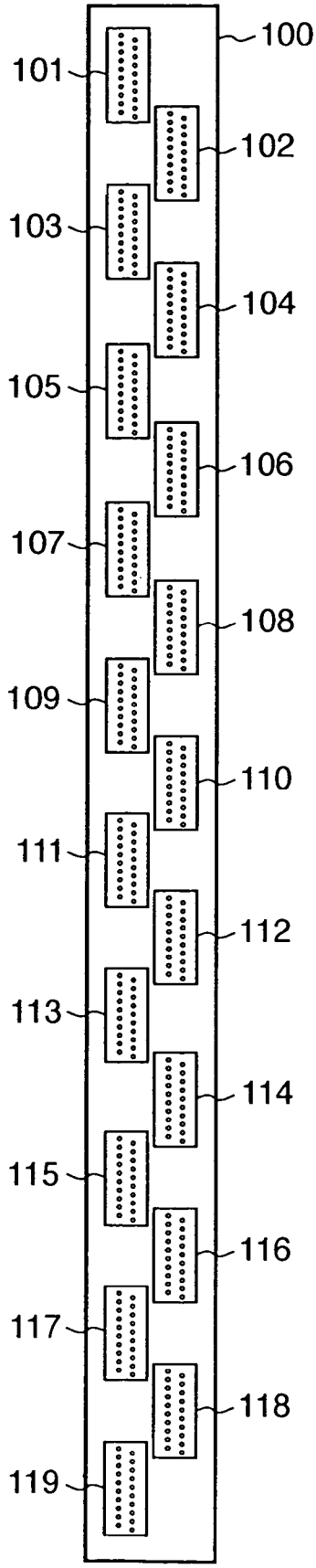
FIG. 11 is a view showing the nozzle layout of a full-line printhead according to the first embodiment of the present invention.

FIG. 11 is a view showing the nozzle layout of a full-line printhead according to the first embodiment of the present invention.

Referring to FIG. 11, 19 nozzle groups 101 to 119 are arrayed on a full-line printhead 100 (to be referred to as a printhead hereinafter). Each nozzle group has nozzles arrayed at an interval corresponding to a resolution of 1,200 dpi (about 21.2 μm). Each nozzle group is formed from a chip having 640 nozzles. This printhead uses 19 chips and comprises a total of 12,160 nozzles. These 19 chips are so arrayed as to overlap each other by two nozzles at their connected portions. Hence, the total number of effective nozzles is 12,124 (=12,160−2×18).

The nozzles of each chip are divided into four driving blocks every four nozzles, and discharge ink droplets by sequentially driving blocks 1 to 4.

Figure 12:
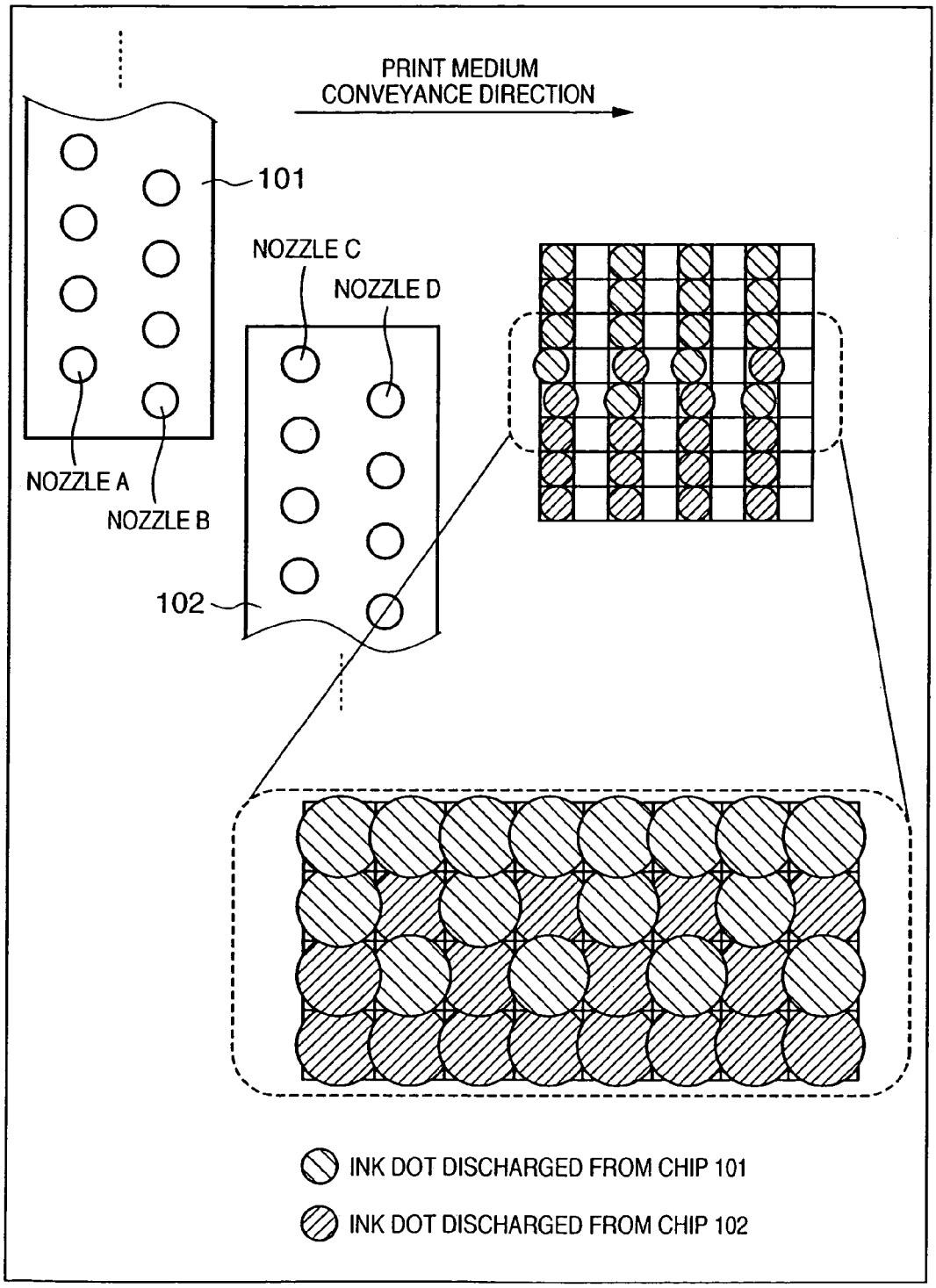
FIG. 12 is a view showing the relationship between the nozzle layout at a chip connected portion and the ink discharge position.

FIG. 12 is a view showing the relationship between the nozzle layout at the chip connected portion and the ink discharge position.

As shown in FIG. 12, nozzle portions (nozzle A, nozzle B, nozzle C, and nozzle D) at the overlapping portion between chips are set so that the discharge contribution from the chips is allocated to 1:1, i.e., the chips alternately discharge ink.

Further, the array interval between chips in the print medium conveyance direction is adjusted, and the discharge timings of all the chips are adjusted relatively so as to attach ink droplets onto the same line.

With these settings, a high-quality line can be formed even when a line pattern such as a ruled line pattern is printed.

A printhead having the arrangement shown in FIGS. 11 and 12 is mounted in a printing apparatus having the arrangement as shown in FIG. 1. Hence, the printhead 100 is applied to printheads 1 to 4 shown in FIG. 1.

The printhead according to the first embodiment is designed to discharge an ink droplet of 5.0±0.5 pl. Color ink containing a coloring material is ink for an inkjet printer BJF900 (available from Canon), and the print medium is inkjet photo glossy paper (Pro Photo Paper PR-101: available from Canon).

The printhead and its printing method will be described in detail.

In the first embodiment, the ink droplet discharge driving frequency is set to 8 kHz, and an image used for description is an image at density levels of 100% duty, 75% duty, 50% duty, and 25% duty for 5.0 pl/dot. The image is printed at a size of 203.2 mm×279.4 mm on an A4-size paper sheet (210 mm×297 mm).

Processing of actually printing this image (to be referred to as image 1 hereinafter) will be explained.

First, the image size is read, and nozzle groups for use are selected, as needed.

The number of nozzles used to print image 1 is 9,600 (=203.2 mm/25.4 mm×1,200 dpi), which is smaller than the total number of effective nozzles (12,124 nozzles) of the printhead.

Figure 13:
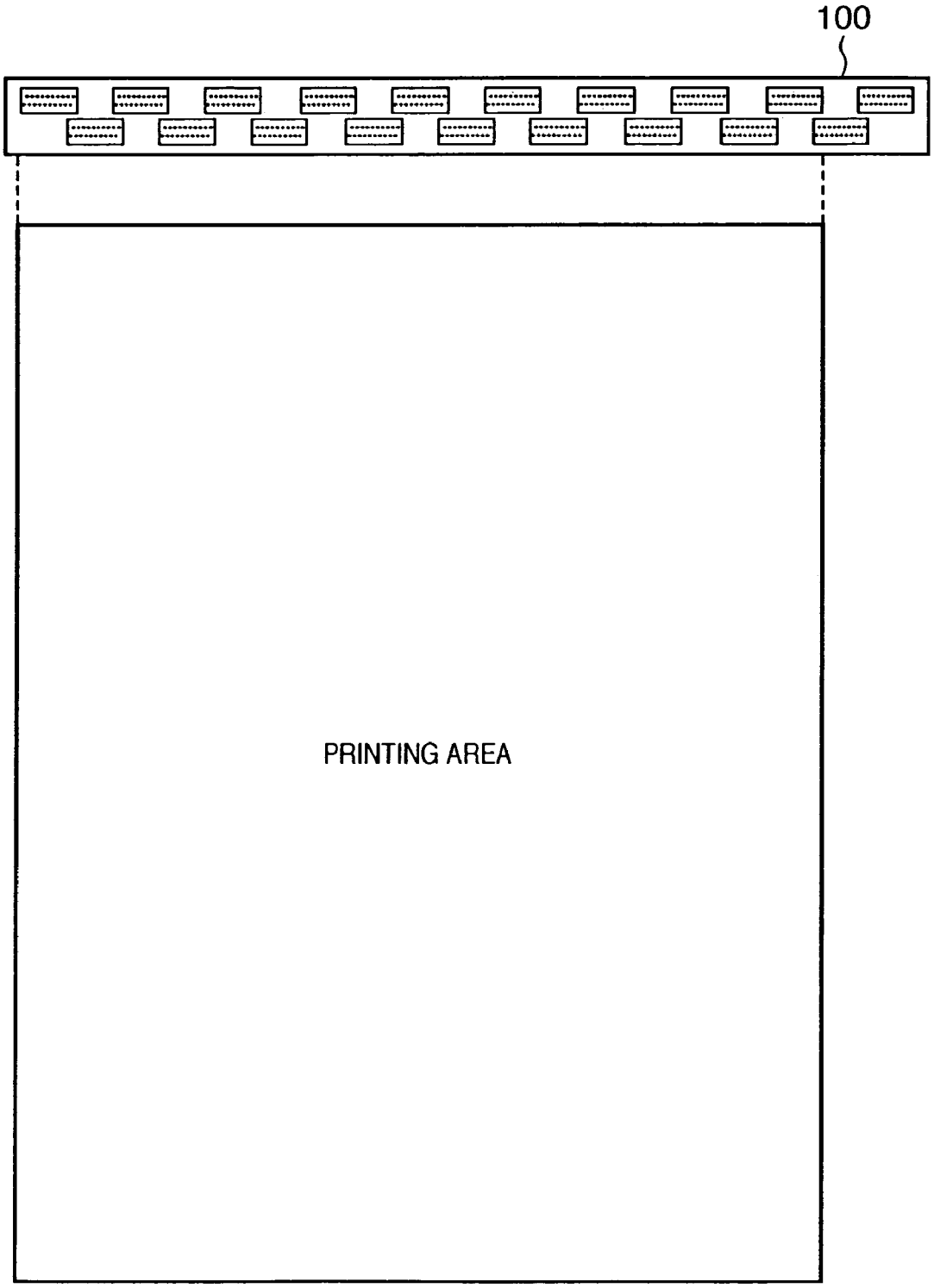
FIG. 13 is a view schematically showing the relationship between the printhead and the printing area when image 1 is printed.

FIG. 13 is a view schematically showing the relationship between the printhead and the printing area when image 1 is printed.

Then, nozzle groups necessary for printing are selected from all the nozzle groups of the printhead.

In this case, nozzle groups for use are selected so that the connected portions between chips which form the printhead print at portions near the ends of the printing area.

More specifically, 1,262 nozzles at the two ends of the printhead are set as unused nozzle groups, and the remaining nozzle groups are selected for use.

Figure 14:
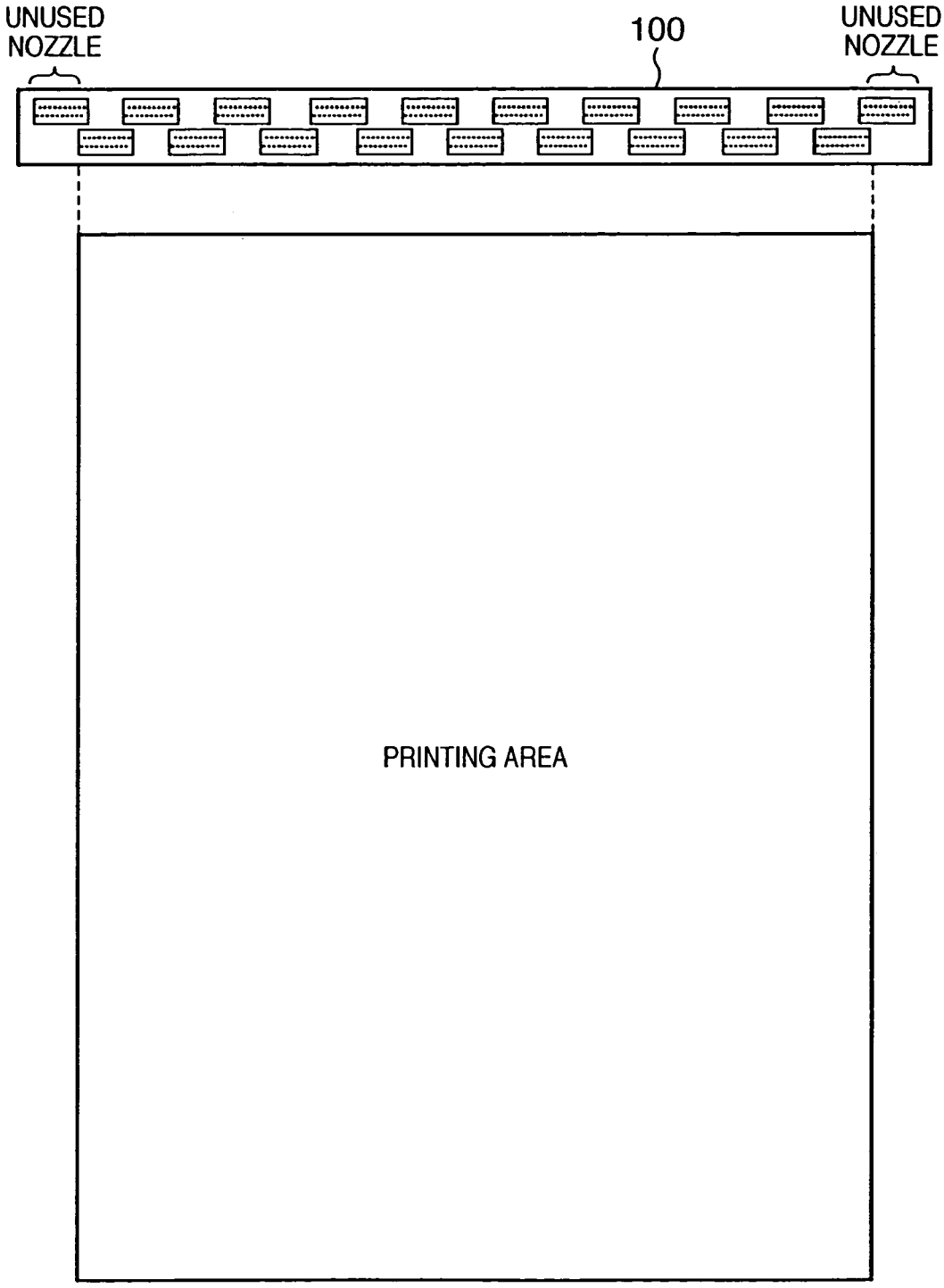
FIG. 14 is a view showing nozzles not used to print image 1.

FIG. 14 is a view showing nozzles not used to print image 1.

After that, a printhead position control unit 39 operates a printhead position control motor 6, and moves the printheads 1 to 4 (printheads 100) via a printhead moving belt 7 in the direction indicated by the arrow A in FIG. 1 so as to print on a print medium by the nozzle groups used.

The printhead moving amount is set to, e.g., about 26.7 mm (=1,262×about 21.2 μm) so as to leave 1,262 nozzles at the two ends of the printhead unused.

At this time, unused nozzle groups or unused nozzles are determined as shown in FIG. 14, and the positional relationship between the printhead 100 and the print medium is determined. As described above, dummy image data is transferred to add blank data to image data so as to prevent ink discharge from the unused nozzle groups in printing.

When image 1 was printed under these setting conditions, the image could be printed with a satisfactory image quality without any degradation of the image quality such as striped nonuniformity and moiré nonuniformity on printed images corresponding to the connected portions between chips in respective images of density levels at the four duty ratios.

Second Embodiment

Printing is performed using the printing apparatus shown in FIG. 1 and the printhead 100 described in the first embodiment under the same condition settings as those in the first embodiment except the print image size and print medium size.

As the print medium, L-size inkjet photo glossy paper (Pro Photo Paper PR-101L: available from Canon) is used.

As the print image, a photographic image (to be referred to as image 2 hereinafter) is prepared, and the image is printed at a size of 89 m×127 mm on the above-mentioned paper sheet of the L size (89 mm×127 mm).

In the second embodiment, similar to the first embodiment, the image size is read, and nozzle groups for use are selected, as needed. The number of nozzles used to print image 2 is 4,205 (=89 mm/25.4 mm×1,200 dpi), which is much smaller than the total number of effective nozzles (12,124 nozzles) of the printhead.

Figure 15:
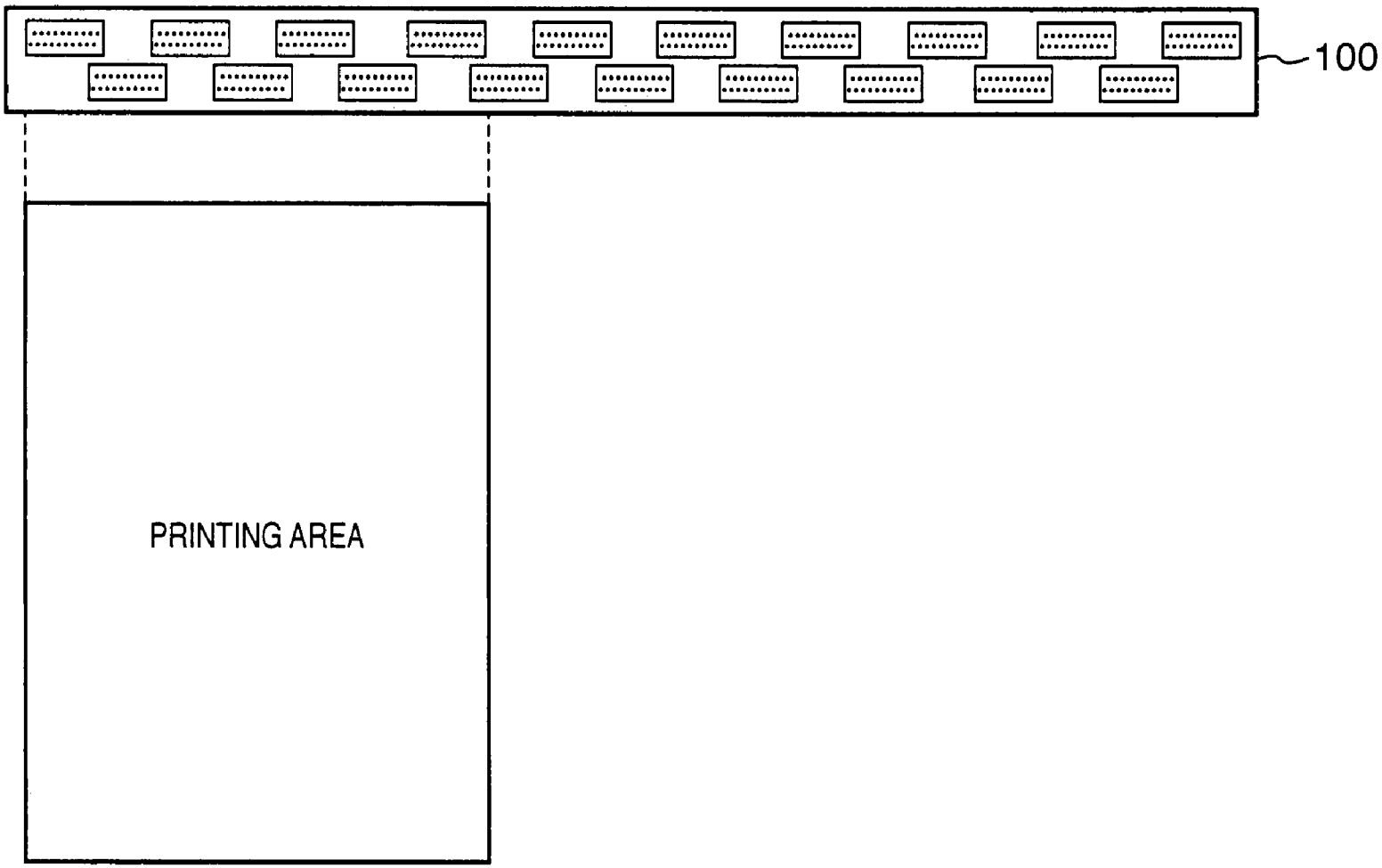
FIG. 15 is a view schematically showing the relationship between the printhead and the printing area when image 2 is printed.

FIG. 15 is a view schematically showing the relationship between the printhead and the printing area when image 2 is printed.

Then, nozzle groups necessary for printing are selected from all the nozzle groups of the printhead.

In this case, nozzle groups for use are selected such that the connected portions between chips which form the printhead are located near the ends of the printing area and the areas of the connected portions do not overlap the printing area as much as possible.

More specifically, nozzles are successively used from one end of the printhead, and the remaining 7,919 nozzles up to the other end are selected as unused nozzle groups.

Figure 16:
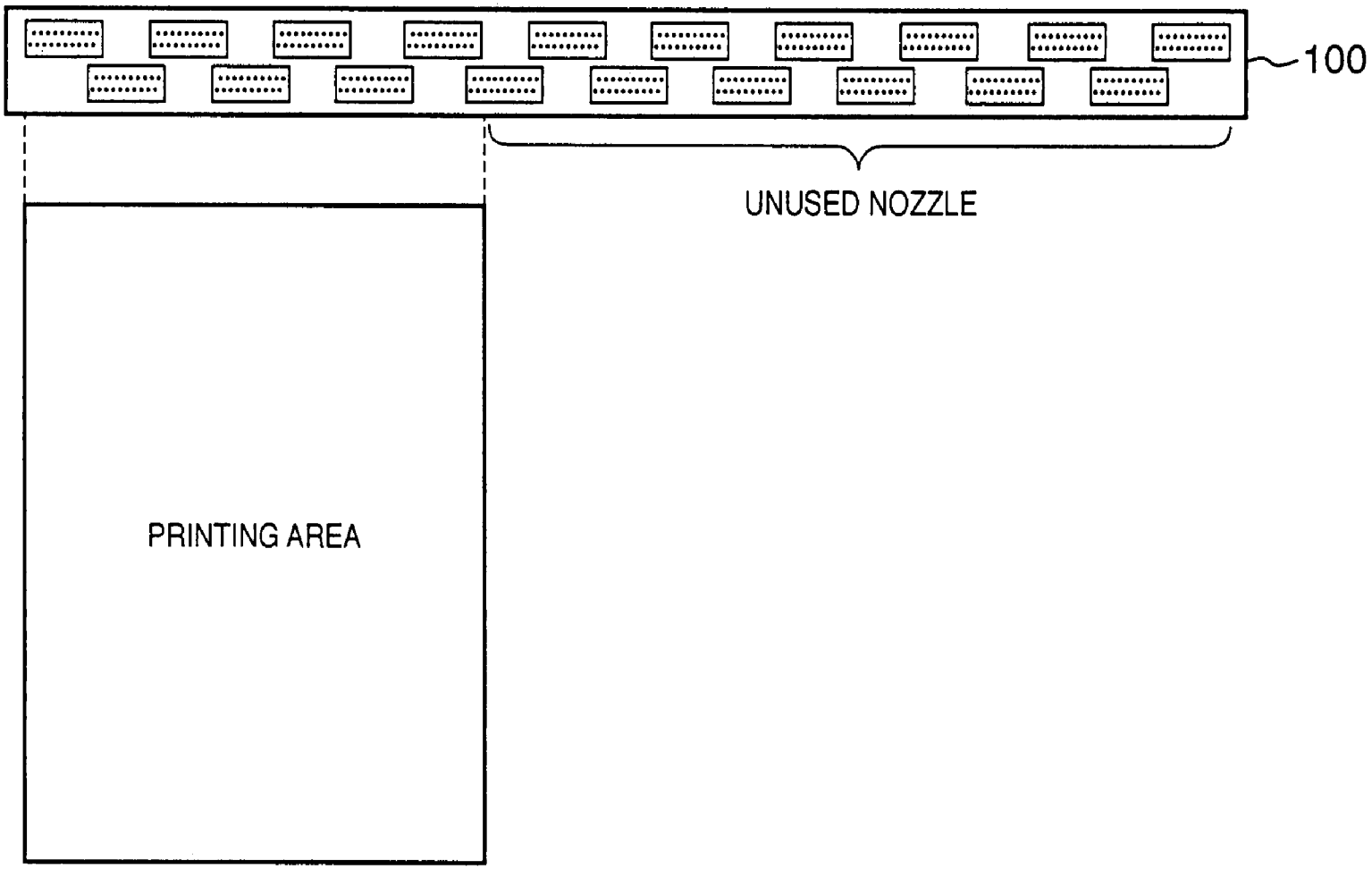
FIG. 16 is a view showing nozzles not used to print image 2.

FIG. 16 is a view showing nozzles not used to print image 2.

Thereafter, a printhead position control unit 39 operates a printhead position control motor 6, and moves printheads 1 to 4 (printheads 100) via a printhead moving belt 7 in the direction indicated by the arrow A in FIG. 1 so as to be able to print on a print medium by the nozzle groups used.

The printhead moving amount is set to a moving amount with which a nozzle at one end of the printhead coincides with the leading end of the printing area. In this case, the printhead is not actually moved. In a case where the initial position of the printhead does not coincide with the leading end of the printing area, the printhead must be moved to make a nozzle at one end of the printhead coincide with the leading end of the printing area.

At this time, the positional relationship between the printhead 100 and the print medium is determined, as shown in FIG. 16. As described above, dummy image data is transferred to add blank data to image data so as to prevent ink discharge from the unused nozzle groups in printing.

When image 2 was printed under these setting conditions, the image could be printed with a satisfactory image quality without any degradation of the image quality such as striped nonuniformity and moiré nonuniformity on printed images corresponding to the connected portions between chips in the photographic image. Also, no connected portion was recognized, and high image quality could be attained.

Third Embodiment

Figure 17:
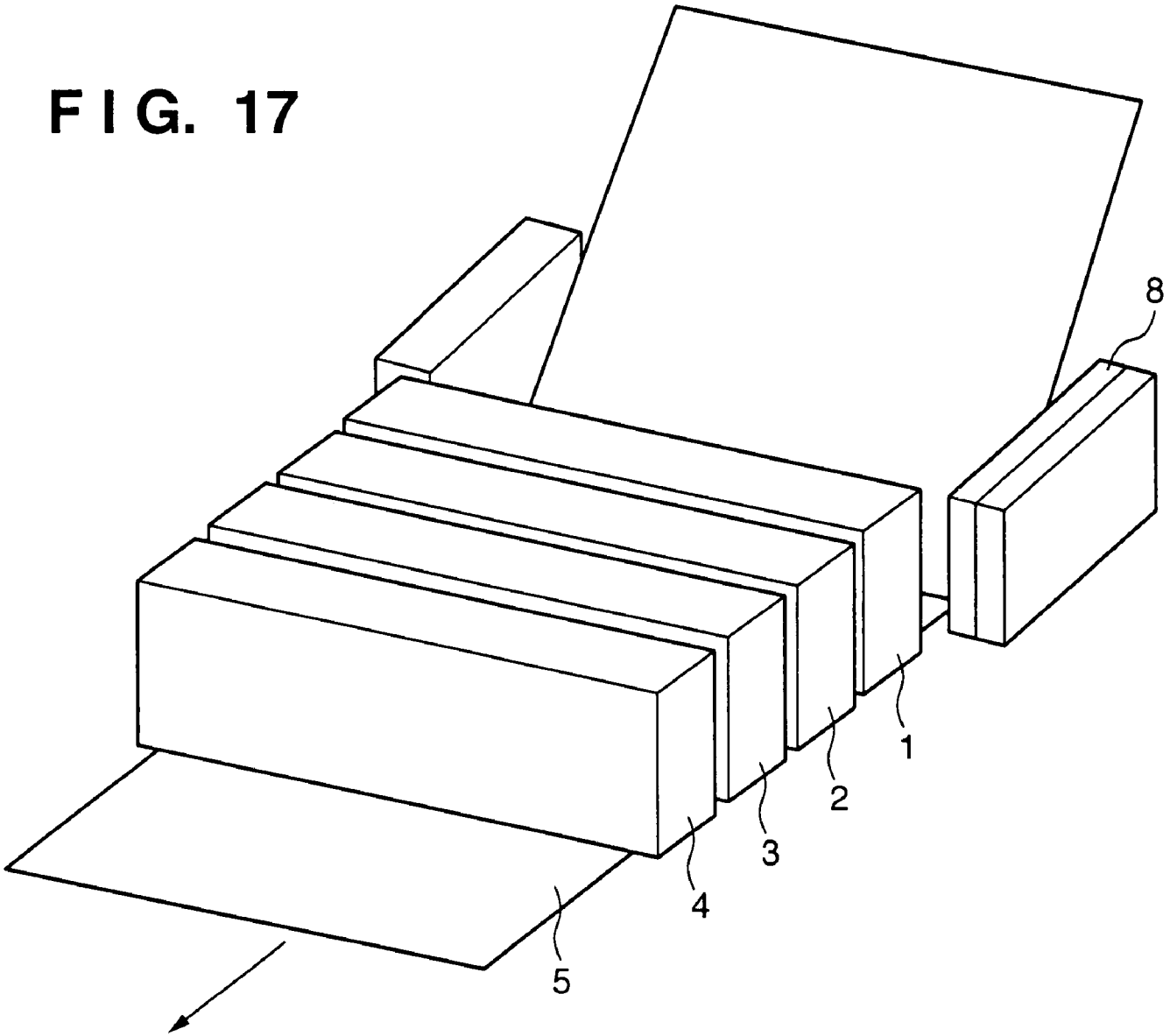
FIG. 17 is an outer perspective view showing the schematic arrangement of a printing apparatus adopted in the third embodiment.

FIG. 17 is an outer perspective view showing the schematic arrangement of a printing apparatus adopted in the third embodiment. In FIG. 17, the same reference numerals as those in the first embodiment denote the same parts, and a description thereof will be omitted.

The characteristic arrangement of the printing apparatus shown in FIG. 17 is a paper supply unit 8 which fixes the print medium supply position in advance in accordance with the size of a print medium for use.

The paper supply unit 8 sets the print medium fixing position so that portions printed by the connected portions between chips which form the printhead are located at visually least perceivable positions on a print medium. For this reason, the position of a print medium in the paper supply unit 8 is uniquely determined by selecting the size of a print medium for use.

In the third embodiment, printing is performed using a printing apparatus having the above arrangement under the same condition settings as those in the second embodiment.

The printhead used in the third embodiment is one shown in FIG. 11 (total number of effective nozzles is 12,124), similar to the first and second embodiments.

Figure 18:
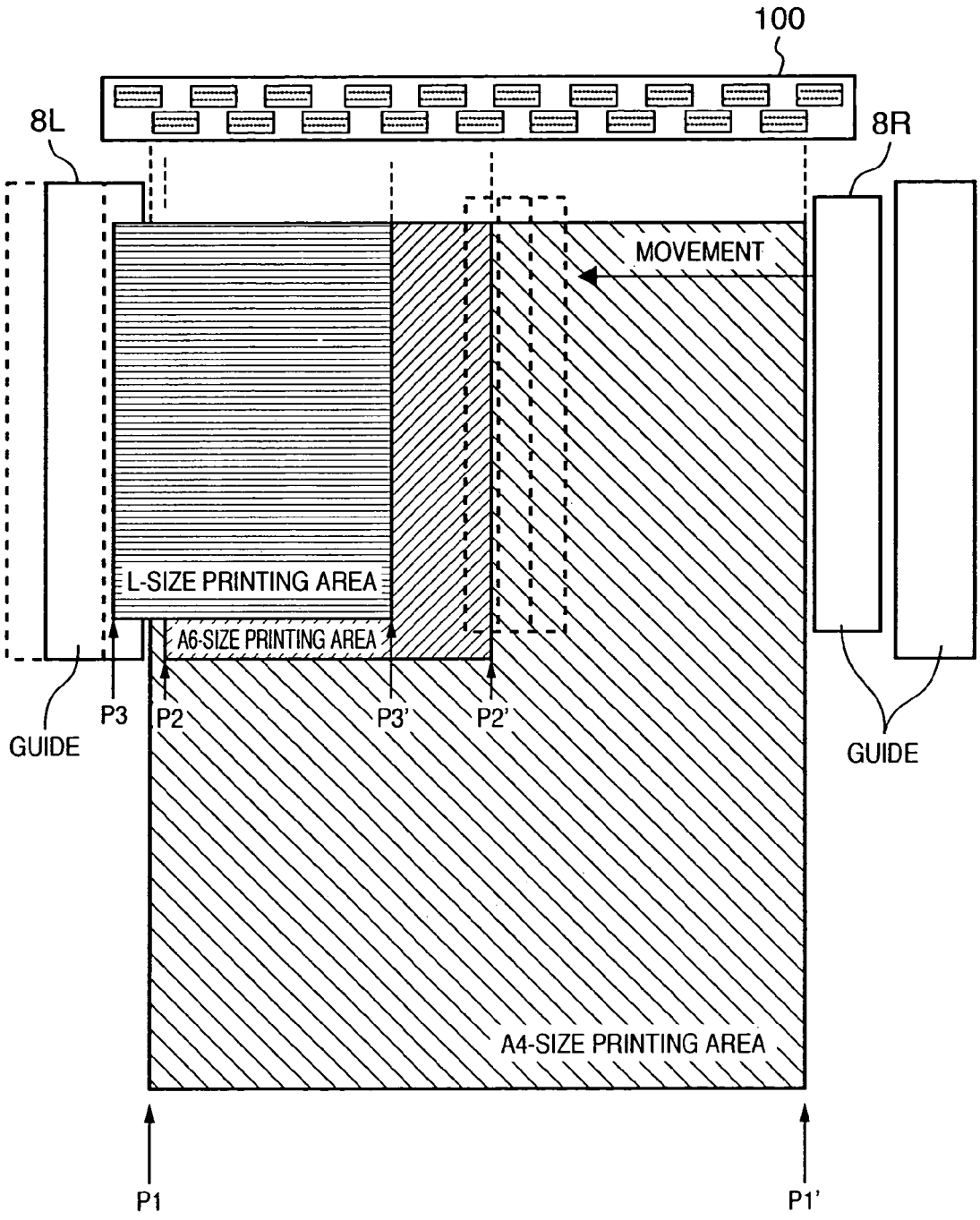
FIG. 18 is a view schematically showing a plurality of print medium sizes and corresponding print medium supply positions.

FIG. 18 is a view schematically showing a plurality of print medium sizes and corresponding print medium supply positions. In FIG. 18, reference numerals 8R and 8L denote right and left guides included in the paper supply unit 8.

As is apparent from FIG. 18, the two end positions of a print medium are P1 and P1' for A4-size paper (210 mm×297 mm), P2 and P2' for A6-size paper (105 mm×148.5 mm), and P3 and P3' for L-size paper (89 mm×127 mm).

At this time, the relative positions of the printhead 100 and print medium are designed as follows: for an A4-size print medium, the connected portions between chips are located at the two ends of the print medium; for an A6-size print medium, not only the connected portions are located at the two ends of the print medium, but also a smallest number of connected portions fall within the print image; and for an L-size print medium, similar to the A6-size print medium, a smallest number of connected portions fall within the print image.

The third embodiment employs the same discharge ink droplet size, printhead driving frequency, and ink used as those in the first embodiment, and employs a print medium identical to that in the second embodiment. An image to be printed is image 2, similar to the second embodiment, and the image is printed at a size of 89 mm×127 mm on a paper sheet of the L size (89 mm×127 mm) used in the second embodiment.

In the third embodiment, similar to the second embodiment, the image size is read, and nozzle groups for use are selected, as needed.

The number of nozzles used to print image 2 is 4,205 (=89 mm/25.4 mm×1,200 dpi), which is much smaller than the total number of effective nozzles (12,124 nozzles) of the printhead.

In the third embodiment, the supply position of a print medium to the paper supply unit 8 is determined in accordance with the size of a print medium used for printing, as already described with reference to FIG. 18.

At these settings, the guides 8R and 8L of the paper supply unit are moved in accordance with an L-size paper sheet. By supplying a paper sheet to this position, the relative positions of the printhead and print medium are determined, and nozzle groups for use are also determined.

More specifically, printing on an L-size print medium uses nozzle groups of the printhead 100 from a nozzle at the left end, and the remaining 7,919 nozzles up to the right end are selected as unused nozzle groups or unused nozzles.

Figure 19:
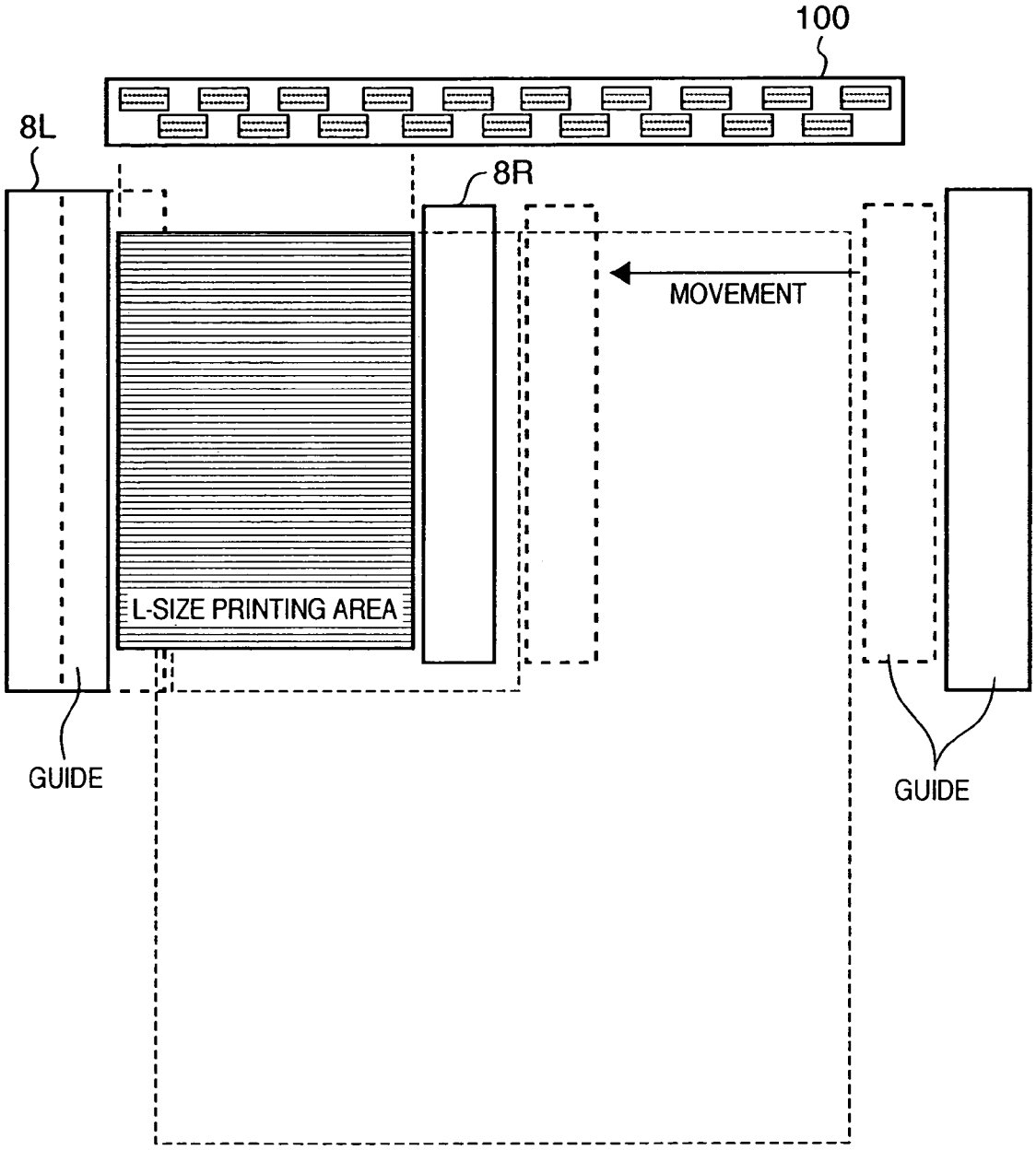
FIG. 19 is a view schematically showing the relationship between the printhead and the printing area in the use of an L-size paper sheet.

FIG. 19 is a view schematically showing the relationship between the printhead and the printing area in the use of an L-size paper sheet.

Similar to the first and second embodiments, dummy image data is transferred to add blank data to image data in the above-described manner so as to prevent ink discharge from the unused nozzle groups or unused nozzles in printing.

When image 2 was printed under these setting conditions, the image could be printed with a satisfactory image quality without any degradation of the image quality such as striped nonuniformity and moiré nonuniformity on printed images corresponding to the connected portions between chips in the photographic image. Further, no connected portion was recognized, and high image quality could be attained.

Comparative Example

This comparative example will examine an image quality obtained when the same full-line printhead 100 as those used in the first to third embodiments is mounted in a printing apparatus having no printhead moving mechanism and image 1 is printed on an A4-size paper sheet under the same condition settings as those in the first embodiment.

Figure 20:
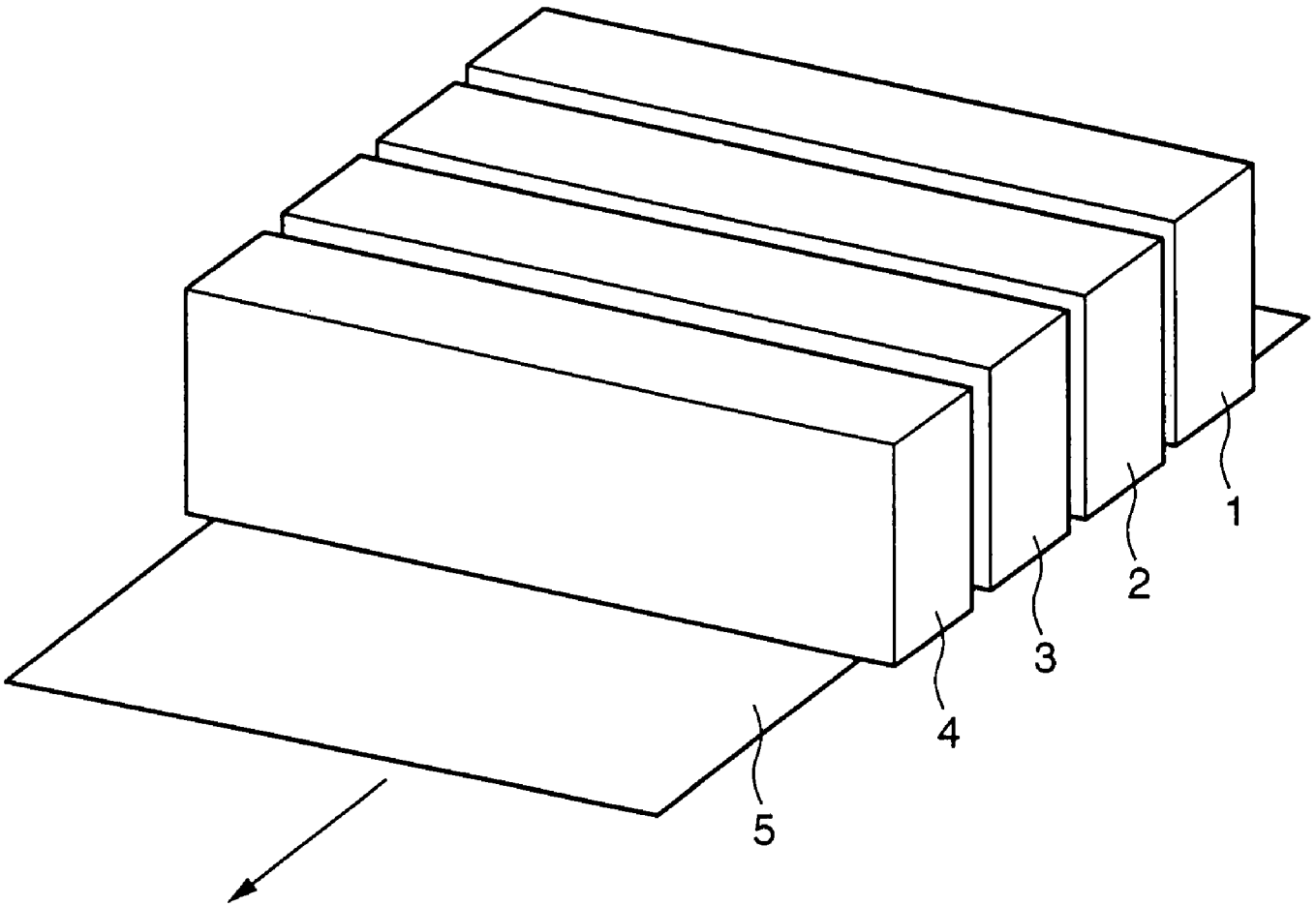
FIG. 20 is a perspective view showing the schematic arrangement of a printing apparatus adopted in a comparative example.

FIG. 20 is a perspective view showing the schematic arrangement of the printing apparatus adopted in the comparative example.

As is apparent from a comparison between FIGS. 20 and 1, the printing apparatus comprises neither the printhead position control motor 6 nor printhead moving belt 7, and is configured similar to a general printing apparatus. The same reference numerals as those in FIG. 1 denote the same parts, and a description thereof will be omitted.

The general printing apparatus does not perform any special processing in selecting nozzle groups necessary for printing from all the nozzles of the printhead. Thus, 9,600 nozzles are used sequentially from the first nozzle (nozzle at one end of the nozzle array). As described in the first embodiment, the number of nozzles used for actual printing image 1 is 9,600, which is smaller than the total number of effective nozzles (12,124 nozzles) of the printhead.

As described above in the first to third embodiments, dummy image data is transferred to add blank data to image data so as to prevent ink discharge from unused nozzle groups in printing.

Figure 21:
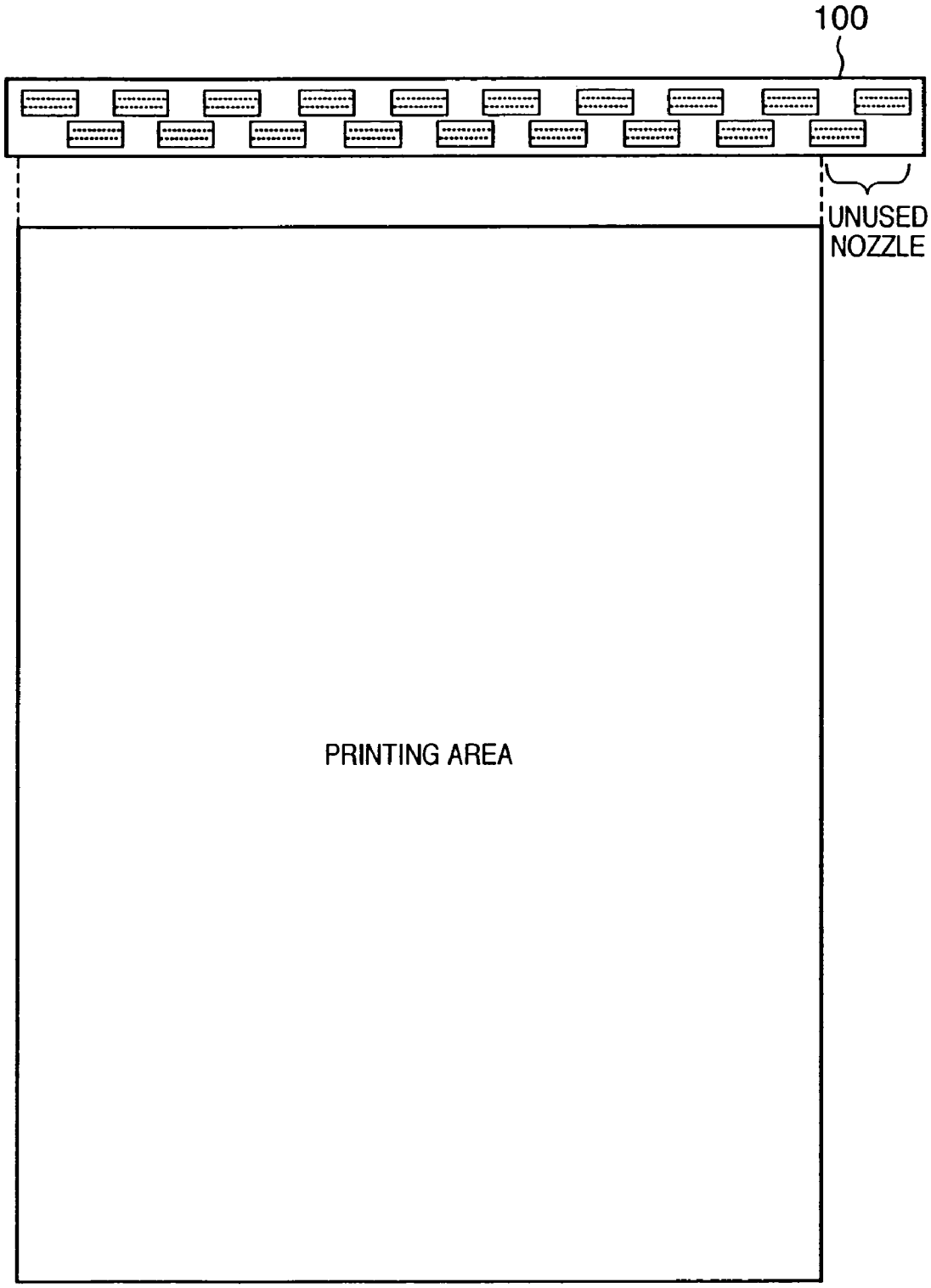
FIG. 21 is a view showing the positional relationship between the printing area and unused nozzles of the printhead.

FIG. 21 is a view showing the positional relationship between the printing area and unused nozzles of the printhead.

When image 1 was printed under these setting conditions, degradation of the image quality such as striped nonuniformity and moiré nonuniformity appeared in respective images of density levels at the four duty ratios at the connected portions between chips upon continuous printing. Since many printed portions corresponding to the connected portions existed on the print medium, degradation of the image quality became readily visually perceivable. Also, in a case where another photographic image was printed, printed portions corresponding to the connected portions between chips were recognized upon continuous printing, degrading the image quality at the connected portions.

From a comparison between the comparative example and the first to third embodiments, high-quality image printing can be achieved by dynamically selecting nozzle groups or nozzles used for printing in accordance with the size of the print medium.

In the above embodiments, generally, liquid droplets discharged from the printhead are ink, and a liquid contained in the ink tank is ink, but the content of the ink tank is not limited to ink. For example, the ink tank may contain a processing solution to be discharged onto a print medium in order to increase the fixing properties, water repellency, or quality of a printed image.

Of ink-jet printing methods, the embodiments can adopt a method which comprises a means (e.g., an electrothermal transducer or laser beam) for generating thermal energy as energy utilized to discharge ink and changes the ink state by thermal energy. This ink-jet printing method can increase the printing density and resolution.

In addition, the printing apparatus according to the present invention may be arranged integrally or separately as an image output terminal for an information processing device such as a computer. Also, the printing apparatus according to the present invention may take the form of a copying apparatus combined with a reader or the like, or the form of a facsimile apparatus having a transmission/reception function.

As many apparently widely different embodiments of the present invention can be made without departing from the spirit and scope thereof, it is to be understood that the invention is not limited to the specific embodiments thereof except as defined in the appended claims.

CLAIM OF PRIORITY

This application claims priority from Japanese Patent Application No. 2004-171676 filed on Jun. 9, 2004, the entire contents of which are incorporated herein by reference.

What is claimed is:

1. A printing apparatus which incorporates a full-line printhead that is configured by arraying a plurality of substrates each prepared by arraying a plurality of printing elements and each having a first printing width and that has a second printing width larger than the first printing width, and which conveys a print medium in a direction different from an array direction of the plurality of printing elements having the second printing width to print on the print medium, comprising:

moving means for moving a relative position of the full-line printhead in the array direction of the plurality of printing elements which form the full-line printhead;

input means for inputting an image printing width on the print medium;

selection means for selecting printing elements to be used for printing at the image printing width in accordance with the image printing width input from said input means;

determination means for determining a moving amount by said moving means so as to print by using the printing elements selected by said selection means;

moving control means for controlling said moving means to move a relative position of the full-line printhead to the print medium by the moving amount determined by said determination means; and printing control means for controlling to print by using the printing elements selected by said selection means at the position to which the full-line printhead is moved by said moving means.

2. The apparatus according to claim 1, wherein said selection means selects printing elements so as to decrease a frequency at which areas printed on the print medium by using printing elements corresponding to connected portions between the plurality of substrates appear on the print medium, in comparison with a frequency before selection by said selection means.

3. The apparatus according to claim 1, wherein movement by said moving means and selection by said selection means are performed in a case where the image printing width is smaller than the second printing width.

4. The apparatus according to claim 1, wherein said selection means selects printing elements so as to print in an area at an end of the print medium by printing elements corresponding to connected portions between the plurality of substrates in order to make an area printed on the print medium by the printing elements corresponding to the connected portions between the plurality of substrates be a visually least perceivable area on the print medium.

5. The apparatus according to claim 1, wherein said selection means selects printing elements so as to minimize printing by printing elements corresponding to connected portions between the plurality of substrates in order to make an area printed on the print medium by the printing elements corresponding to the connected portions between the plurality of substrates be a visually least perceivable area on the print medium.

6. The apparatus according to claim 1, wherein said moving means has means for moving the full-line printhead.

7. The apparatus according to claim 1, wherein said moving means has means for moving a supply position of the print medium in accordance with a size of the print medium.

8. The apparatus according to claim 1, wherein the printing apparatus comprises a plurality of full-line printheads along a conveyance direction of the print medium for color printing.

9. A printing method of printing on a print medium by employing a full-line printhead that is configured by arraying a plurality of substrates each prepared by arraying a plurality of printing elements and each having a first printing width and that has a second printing width larger than the first printing width, and conveying the print medium in a direction different from an array direction of the plurality of printing elements having the second printing width, comprising:

an input step of inputting an image printing width on the print medium;

a selection step of selecting printing elements to be used for printing at the image printing width in accordance with the image printing width input at said input step;

a determination step of determining a moving amount of the full-line printhead so as to print by using the printing elements selected at said selection step;

a moving control step of controlling to move a relative position of the full-line printhead to the print medium by the moving amount determined at said determination step in the array direction of the plurality of printing elements which form the full-line printhead; and a printing control step of controlling to print by using the printing elements selected at said selection step at the position to which the full-line printhead is moved at said moving control step.

10. The method according to claim 9, wherein at said selection step, printing elements are so selected as to decrease a frequency at which areas printed on the print medium by using printing elements corresponding to connected portions between the plurality of substrates appear on the print medium, in comparison with a frequency before selection at said selection step.

* * * * *

UNITED STATES PATENT AND TRADEMARK OFFICE

CERTIFICATE OF CORRECTION

PATENT NO. : 7,278,700 B2
APPLICATION NO. : 11/148332
DATED : October 9, 2007
INVENTOR(S) : Yamaguchi et al.

It is certified that error appears in the above-identified patent and that said Letters Patent is hereby corrected as shown below:

COLUMN 1:
Line 55, “printing” should read --printing.--.

COLUMN 3:
Line 43, “that has” should be deleted.

COLUMN 4:
Line 34, “that has” should be deleted.

COLUMN 9:
Line 36, “in” (first occurrence) should be deleted.

COLUMN 13:
Line 3, “89 m×127 mm” should read --89 mm×127 mm--.

COLUMN 15:
Line 25, “actual” should read --actually--.

COLUMN 16:
Line 23, “that has” should be deleted.

COLUMN 17:
Line 23, “that has” should be deleted.

Signed and Sealed this

Third Day of March, 2009

John Doll

JOHN DOLL
*Acting Director of the United States Patent and Trademark Office*